US006771236B1

(12) United States Patent
Konishi et al.

(10) Patent No.: US 6,771,236 B1
(45) Date of Patent: Aug. 3, 2004

(54) DISPLAY PANEL AND DISPLAY DEVICE TO WHICH THE DISPLAY PANEL IS APPLIED

(75) Inventors: Morikazu Konishi, Kanagawa (JP); Masami Okita, Tokyo (JP); Takahiro Igarashi, Kanagawa (JP); Tsuneo Kusunoki, Kanagawa (JP); Katsutoshi Ohno, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/515,862

(22) Filed: Feb. 29, 2000

(30) Foreign Application Priority Data

Mar. 5, 1999 (JP) ..... P11-058957
Dec. 20, 1999 (JP) ..... P11-361805

(51) Int. Cl.[7] ..... G09G 3/30
(52) U.S. Cl. ..... 345/80; 313/503
(58) Field of Search ..... 345/74.1, 75.1, 345/75.2, 76, 77, 78, 80; 313/336, 503, 496; 315/169.1

(56) References Cited

U.S. PATENT DOCUMENTS 4,855,190 A * 8/1989 Bezner ..... 428/690
5,557,296 A * 9/1996 Lambert et al. ..... 313/422
5,592,056 A * 1/1997 Peyre et al. ..... 315/169.1
5,644,327 A * 7/1997 Onyskevych et al. ..... 313/503
5,742,266 A * 4/1998 Onozuka ..... 313/309
5,796,375 A * 8/1998 Holloman ..... 345/74.1
5,844,531 A * 12/1998 Betsui ..... 315/169.3
6,117,529 A * 9/2000 Leising et al. ..... 257/88
6,317,106 B1 * 11/2001 Beeteson et al. ..... 313/422

* cited by examiner

*Primary Examiner*—Xiao Wu
*Assistant Examiner*—Kevin Nguyen
(74) *Attorney, Agent, or Firm*—Rader, Fishman & Grauer PLLC; Ronald P. Kananen

(57) ABSTRACT

A display panel comprising a substrate, a fluorescence layer which is to be caused to emit light by electrons from a vacuum space, and an anode electrode which is to direct the electrons toward the fluorescence layer, wherein the anode electrode comprises a lower electrode and an upper electrode.

22 Claims, 27 Drawing Sheets

TRANSMISSION TYPE

TRANSMISSION OR
REFLECTION TYPE

REFLECTION TYPE

REFLECTION TYPE

REFLECTION TYPE

TRANSMISSION OR
REFLECTION TYPE

REFLECTION TYPE

TRANSMISSION TYPE

REFLECTION TYPE

REFLECTION TYPE

TRANSMISSION OR
REFLECTION TYPE

REFLECTION TYPE
10
11
12R
13C
131
132
24C

REFLECTION TYPE

REFLECTION TYPE

REFLECTION TYPE

TRANSMISSION OR
REFLECTION TYPE

DISPLAY PANEL AND DISPLAY DEVICE TO WHICH THE DISPLAY PANEL IS APPLIED

BACKGROUND OF THE INVENTION AND RELATED ART STATEMENT

The present invention relates to a display panel and a display device to which the display panel is applied. More specifically, it relates to a display panel having a fluorescence layer which is excited by electrons from a vacuum space to emit light, and a display device into which the display panel is incorporated.

Various flat type (flat panel type) displays are being studied as image display devices which are to replace currently main-stream cathode ray tubes (CRT). The flat type displays include a liquid crystal display (LCD), an electroluminescence display device (ELD) and a plasma display panel (PDP). Further, there is also proposed a cold cathode field emission display device, a so-called field emission device (FED), which is capable of emitting electrons into vacuum from a solid without relying on thermal excitation, and it attracts attention from the viewpoint of a brightness on a screen and a low power consumption.

FIG. 24 shows a typical configuration of FED, in which a display panel 500 and a rear panel 400 are placed to be opposed to each other. These panels 400 and 500 are bonded to each other in circumferential end portions through a frame (not shown), so that vacuum space VAC is formed in a closed space between these two panels. The rear panel 400 has cold cathode field emission devices (to be referred to as "field emission devices" hereinafter) as electron emitting members. In FIG. 24, there is shown a so-called Spindt type field emission device having a conical electron emitting portion 45 as an example of the field emission device. The Spindt type field emission device comprises a cathode electrode 41 formed on a supporting member 40, an insulating interlayer 42 formed on the cathode electrode 41 and the supporting member 40, a gate electrodes 44 formed on the insulating interlayer 42, and the conical electron emitting portion 45 formed in opening portions 43 provided in the gate electrodes 44 and the insulating interlayer 42. Generally, a predetermined number of the electron emitting portions 45 having a predetermined alignment are so arranged as to correspond to one fluorescence layer 51 to be explained later. A relatively negative voltage (video signal) is applied to the electron emitting portion 45 from a cathode electrode driving circuit 46 through the cathode electrode 41, and a relatively positive voltage (scanning signal) is applied to the gate electrode 44 from a gate electrode driving circuit 47. Electrons are emitted from the top of the electron emitting portion 45 depending upon an electric field generated by the application of these voltages. The electron emitting member is not limited to the above Spindt type field emission device. A so-called edge type field emission device is used in some cases, and other types such as a flat type field emission device, a crown type field emission device and the like are also used in some cases. Further, sometimes the above is the other way round, that is, a scanning signal is inputted to the cathode electrode 41, and a video signal is inputted to the gate electrode 44.

The display panel 500 has a plurality of fluorescence layers 51 formed on a transparent substrate 50 composed of glass or the like, and a conductive reflective film 52. The fluorescence layer 51 is formed in the form of a matrix or stripes, and the conductive reflective film 52 is formed on the fluorescence layer 51 and the transparent substrate 50. A positive voltage higher than the positive voltage applied to the gate electrode 44 is applied to the conductive reflective film 52 from an acceleration power source (anode electrode driving circuit) 53, and the conductive reflective film 52 works to direct electrons emitted into the vacuum space VAC from the electron emitting portion 45 toward the fluorescence layer 51. Further, the conductive reflective film 52 has the following functions. It protects fluorescence particles constituting the fluorescence layer 51 from the sputtering by particles such as ions, it reflects light emitted by the fluorescence layer 51 due to electron excitation toward the transparent substrate 50 to improve the brightness of a display screen viewed from outside the transparent substrate 50, and it also prevents an excess charge to stabilize the potential of the display panel 500. That is, the conductive reflective film 52 has both the function of an anode electrode and the function of a member known as a metal-back layer in the field of cathode ray tubes (CRT). The conductive reflective film 52 is generally composed of an aluminum thin film.

FIG. 25A shows a schematic plan view of a display panel in which the fluorescence layers 51R, 51G and 51B are formed in a matrix form, and FIG. 25B shows a schematic partial cross-sectional view taken along an X—X line in FIG. 25A. A region where the fluorescence layers 51R, 51G and 51B are arranged is an effective region which practically works as a display device, and an anode electrode forming region corresponds nearly to the above effective region. For clarification, the anode electrode forming region is indicated by slanting lines in FIG. 25A. A circumferential region of the effective region is an idle region which supports functions of the effective region such as the housing of peripheral circuits and the mechanical support of a display screen. A lead portion 54 used for connecting the anode electrode to the acceleration power source (see acceleration power source 53 in FIG. 24) which supplies a power, for example of 5 kV is formed on an edge portion of the transparent substrate 50. Between the acceleration power source and the anode electrode is generally provided a resistance member (a resistance value of 100 MΩ in a shown example) for preventing an over-current and discharging. The resistance member is provided outside the substrate.

The anode electrode in an FED is not so necessarily required to be composed of the conductive reflective film 52 as described above. As is shown in a schematic partial cross-sectional view of FIG. 25C taken along an X—X line in FIG. 25A, there may be employed a constitution in which a transparent conductive film 55 formed on the transparent substrate 50 has the function of the anode electrode. The region where the conductive reflective film 52 or the transparent conductive film 55 which works as an anode electrode is formed covers nearly the entire area of the effective region on the transparent substrate 50.

FIG. 26A shows a schematic plan view of a display panel in which the fluorescence layers are formed in a stripe form, and FIGS. 26B and 26C show schematic partial cross-sectional views taken along an X—X line in FIG. 26A. Some members in FIGS. 26A to 26C are the same as those in FIGS. 25A to 25*c* and indicated by the same reference numerals, and detailed explanations thereof are omitted. FIG. 26B shows a configuration in which the anode electrode is composed of a conductive reflective film 52. FIG. 26C shows a configuration in which the anode electrode is composed of a transparent conductive film 55. The region where the conductive reflective film 52 or the transparent conductive film 55 which works as an anode electrode is formed covers nearly the entire area of the effective region of the display panel.

Meanwhile, an FED which is a flat type display device has a far smaller flying distance of electrons than a cathode ray tube, so that the electron acceleration voltage cannot be so increased as a cathode ray tube. That is, when the electron acceleration voltage is too high in the FED, a spark discharge is liable to take place very easily between the electron emitting portion on the rear panel and the film which works as an anode electrode, which may highly possibly downgrade the image quality to a large extent. In the discharge generating mechanism in a vacuum space, presumably, a small discharge is first triggered by the release of electrons and ions from electron emitting portions under a strong electric field, and the anode electrode is supplied with energy to increase a local temperature of the anode electrode, or an occlusion gas inside the anode electrode is released or an anode-electrode-forming material itself is vaporized, so that a small discharge grows to be a spark discharge. Beside the acceleration power source, energy stored or accumulated in an electrostatic capacitance between the anode electrode and the electron emitting portion or between the anode electrode and the cathode electrode may possibly become an energy source which promotes the growth to a spark discharge. For inhibiting the spark discharge, it is effective to control the emission of electrons and ions which trigger the discharge, while it is required to control the particles extremely strictly therefor. In a general production process of display panels or display devices using the display panels, practicing the above control involves great technical difficulties.

The FED for which a low acceleration voltage of electrons is inevitably selected causes characteristic problems which are not found in a cathode ray tube. In a cathode ray tube in which high-voltage acceleration is carried out, the penetration depth of electrons into a fluorescence layer is large, so that the energy of the electrons is received in a relatively large region inside the fluorescence layer. A relatively large number of fluorescence particles in the above large region can be therefore simultaneously excited to achieve a high brightness. In contrast, in the FED, the penetration depth of electrons into the fluorescence layer is small, so that the energy of electrons can be received only in a narrow region. For attaining a practically satisfactory brightness, it is required to increase the density of electrons emitted from the field emission device (i.e., to increase a current density) or to irradiate the fluorescence layer with the electrons for a longer time period than in the cathode ray tube. When the anode electrode is formed on the fluorescence layer, the number of electrons which can transmit the anode electrode is increased by limiting the thickness of the anode electrode to approximately 0.07 $\mu$m, so that the anode electrode cannot be expected to has such an effect that the metal-back layer (generally having a thickness of approximately 0.2 $\mu$m) of the cathode ray tube has on preventing an antistatic charge. It can be therefore said that the fluorescence layer of the field emission device is situated in an environment where it easily degraded due to the long time irradiation of electrons and charging. When the fluorescence layer is composed of a sulfide-containing fluorescence particles, the above degradation appears as a phenomenon in which sulfur as a component thereof is dissociated in the form of a simple substance, sulfur monoxide (SO) or sulfur dioxide ($SO_2$), and the sulfide-containing fluorescence layer changes in composition or is physically disintegrated. The above degradation of the fluorescence layer leads to a variance in the color of emitted light or light emission efficiency and contamination of components inside the FED and finally to a decrease in the reliability and lifetime characteristic of the FED.

Further, the conventional FED has another problem that the brightness of a display screen varies depending upon pixels or sub-pixels selected on the rear panel 400 side. FIGS. 27A and 27B show schematic configurations of the real panel 400. In these Figures, for clarification, a cathode electrodes 41 in a non-selected state (to which a voltage of +50 volts is applied from the cathode electrode driving circuit 46) is indicated by a less dense hatching, and a cathode electrodes 41 in a selected state (to which a voltage of 0 volt is applied from the cathode electrode driving circuit 46) is indicated by a dense hatching. A video signal applied to the cathode electrode 41 in a selected state can have a value of from 0 volt (inclusive) to less than +50 volts depending upon tones, while it is assumed to be 0 volt for simplification. A gate electrodes 44 in a non-selected state (to which a voltage of 0 volt is applied from the gate electrode driving circuit 47) is indicated by a blank, and a gate electrodes 44 in a selected state (to which a voltage of +50 volts is applied from the gate electrode driving circuit 47) is indicated by hatching. A portion where projection images of the cathode electrode 41 and the gate electrode 44 overlap (to be referred to as "overlap region" hereinafter) corresponds to one pixel in a monochromatic display device, or to one sub-pixel in a color display device, and generally, a plurality of field emission devices are arranged per overlap region. An overlap region of the selected cathode electrode 41 and the selected gate electrode 44 is a selected pixel (or a selected sub-pixel), and it is shown by a blank circle in Figure. The gate electrodes 44 will be referred to as a first column, . . . , m-th column, . . . from top to bottom, and the cathode electrodes 41 are referred to as a first row, . . . , n-th row, . . . from left to right.

When it is assumed that the gate electrode 44 on the first column and the cathode electrode 41 on the first row are selected as shown in FIG. 27A, electrons are emitted from the field emission devices arranged in the overlap region positioned on the first column and the first row, and the opposing fluorescence layer 51 emits light. In this case, if it is assumed that a current of 1 $\mu$A flows from the display panel 500 toward the rear panel 400, a voltage drop of 1 $\mu$A×100 MΩ=0.1 kilovolt occurs. That is, an acceleration voltage of 5−0.1=4.9 kilovolts is applied between the rear panel 400 and the display panel 500. When it is assumed that the gate electrode 44 on the 2nd column is selected and, for example, that five cathode electrodes 41 such as those on the 2nd, 6th, 9th, 11th and 14th rows are selected as shown in FIG. 27B, however, a current which flows from the display panel 500 toward the rear panel 400 has a total value of 5 $\mu$A, and a voltage drop of 0.5 kilovolt takes place, so that the acceleration voltage between the rear panel 400 and the display panel 500 decreases to 5.0−0.5=4.5 kilovolts. This means a decrease in the energy of electrons which are to collide with the fluorescence layer 52 and a subsequent decrease in the brightness of a display screen. That is, the brightness of the display screen varies depending upon the number of the cathode electrodes 41 to be selected per column of the gate electrodes 44.

OBJECT AND SUMMARY OF THE INVENTION

It is therefore a first object of the present invention to provide a display panel in which the deterioration of its fluorescence layer caused by a charge can be prevented, and a display device having a long lifetime due to the use of the above display panel.

It is a second object of the present invention to provide a display panel in which a spark discharge can be prevented, and a display device having a long lifetime and high reliability due to the use of the above display panel.

Further, it is a third object of the present invention to provide a display device which exhibits a stabilized brightness on a display screen by keeping a voltage drop in a constant range without regard to the number of selected electrodes to which video signals are inputted on the rear panel side.

The display panel according to a first aspect of the present invention for achieving the above first object is a display panel comprising a substrate, a fluorescence layer which is to be caused to emit light by electrons from a vacuum space, and an anode electrode which is to direct the electrons toward the fluorescence layer, wherein the anode electrode comprises a lower electrode and an upper electrode.

In the display panel according to the first aspect of the present invention, the anode electrode has a two-layered structure comprising a lower electrode and an upper electrode, and charge is removed through both the lower electrode and the upper electrode, so that the deterioration of the fluorescence layer caused by an excess charge can be prevented.

The display device according a first aspect of the present invention for achieving the above first object is a display device comprising the display panel according to the first aspect of the present invention, wherein the display panel and a rear panel having a plurality of electron emitting members are arranged to be opposed to each other through a vacuum space, the display panel comprises a substrate, a fluorescence layer which is to be caused to emit light by electrons emitted from the electron emitting members into the vacuum space, and an anode electrode which is to direct the electrons toward the fluorescence layer, and the anode electrode comprises a lower electrode and an upper electrode.

In the display panel and the display device according to the first aspect of the present invention, structurally, there can be two cases, such as (i) a case where the lower electrode is formed on the substrate, the fluorescence layer is formed on the lower electrode and the upper electrode is formed on the fluorescence layer, and (ii) a case where the fluorescence layer is formed on the substrate, the lower electrode is formed on the fluorescence layer and the upper electrode is formed on the lower electrode.

In both the cases (i) and (ii), the fluorescence layer may be composed of monochromatic fluorescence particles, or it may be composed of fluorescence particles of three primary colors. Further, concerning the alignment configuration of the fluorescence layers, the fluorescence layers may be aligned in the form of a dot matrix, or in the form of stripes. In the alignment configurations of a dot matrix and stripes, gaps between adjacent fluorescence layers may be filled with a black-matrix layer for improving a contrast. When the above black-matrix layer is formed in the case (i), the fluorescence layers and the black-matrix layer are formed on the lower electrode, and the upper electrode is formed on the fluorescence layers and the black-matrix layer. When the above black-matrix layer is formed in the case (ii), the fluorescence layers and the black-matrix layer are formed on the substrate, and the lower electrode is formed on the fluorescence layers and the black-matrix layer. In both the cases, the lower electrode and the upper electrode are electrically connected and have potentials at the same level when the display device is operated.

In each of these cases (i) and (ii), it is determined depending upon which material is used for the lower electrode and the upper electrode, a transparent material or a non-transparent material, whether the material constituting the substrate is transparent or non-transparent. As a consequence, it is determined whether the display device is a transmission type or a reflection type when the display panel is incorporated into the display device. The above transmission type refers to a system in which an image is viewed through the substrate of the display panel, and not only the substrate is required to be transparent, but all the layers interposed between the fluorescence layer and the substrate are also required to be transparent. The above reflection type refers to a system in which an image is viewed through the rear panel placed to be opposed to the display panel, and not only all the components of the rear panel present in the effective region are required to be transparent, but all the layers that are nearer to the rear panel side than the fluorescence layer on the display panel side are also required to be transparent.

In view of the above conditions, the case (i) can be further classified into follows. "TP" stands for "transparent", "N-TP" stands for "non-transparent", "TR" stands for "transmission type display device", and "RF" stands for "reflection type display device".

| Case | Upper electrode | Lower electrode | Substrate | Type of display device |
|---|---|---|---|---|
| (i-1) | N-TP | TP | TP | TR |
| (i-2) | TP | N-TP | TP or N-TP | RF |
| (i-3) | TP | TP | TP | TR or RF |
| (i-4) | TR | TP | N-TP | RF |

In view of the above conditions, the case (ii) is further classified into follows.

| Case | Upper electrode | Lower electrode | Substrate | Type of display device |
|---|---|---|---|---|
| (ii-1) | N-TP | TP | TP | TR |
| (ii-2) | TP or N-TP | N-TP | TP | TR |
| (ii-3) | TP | TP | TP | TR or RF |
| (ii-4) | TP | TP | N-TP | RF |

There may be employed any one of a structure in which both the lower electrode and the upper electrode are so formed as to extend on the entire effective region, a structure in which one is divided into a plurality of independent regions and the other is so formed as to extend on the entire effective region, and a structure in which each of the lower electrode and the upper electrode is divided into a plurality of independent regions. Further, when each of the lower electrode and the upper electrode is divided into a plurality of independent regions, the number of the independent regions of one may be the same, or different from, the number of the independent regions of the other. Particularly, when at least the upper electrode is divided into a plurality of independent regions in the case (i), or when each of the lower electrode and the upper electrode is divided into a plurality of independent regions in the case (ii), the electrostatic capacitance between the anode electrode and the cathode electrode can be decreased due to a decrease in the area of the anode electrode, and the spark discharge can be effectively prevented. A plurality of the independent regions are practically preferably correspondent to a predetermined number of the unit fluorescence layers, and this point will be discussed with regard to a second aspect of the present invention.

The display panel according to a second aspect of the present invention for achieving the above second object is a display panel comprising a substrate, a plurality of unit fluorescence layers which are to be caused to emit light by electrons from a vacuum space, an anode electrode which is to direct the electrons toward the unit fluorescence layers, and a power supply line, wherein the anode electrode comprises a plurality of independent electrodes so formed as to correspond to a predetermined number of the unit fluorescence layers, and each independent electrode is connected to an anode electrode driving circuit through the power supply line.

The display device according the second aspect of the present invention for achieving the above second object is a display device using the display panel according to the second aspect of the present invention, wherein the display panel and a rear panel having a plurality of electron emitting members are arranged to be opposed to each other through a vacuum space, the display device comprises a substrate, a plurality of unit fluorescence layers which are to be caused to emit light by electrons emitted from the electron emitting members into the vacuum space, an anode electrode which is to direct the electrons toward the unit fluorescence layers, and a power supply line, the anode electrode comprises a plurality of independent electrodes so formed as to correspond to a predetermined number of the unit fluorescence layers, and each independent electrode is connected to an anode electrode driving circuit through the power supply line.

The display panel and the display device according to the second aspect of the present invention are based on a basic thought that, instead of preventing the trigger to a discharge, an energy to be stored or accumulated, for example, between the anode electrode and the cathode electrode is controlled to be at a level at which it is not promoted to grow to a spark discharge, so that a discharge of a small scale, if any, is not grown to a spark discharge. Since the anode electrode is formed to have a form of divided independent electrodes having a smaller area each, instead of being so formed as to extend on the entire effective region, the electrostatic capacitance, for example, between the anode electrode and the cathode electrode can be decreased, so that a stored or accumulated energy can be decreased.

The above unit fluorescence layer is defined to a fluorescence layer which generates one bright point on the display panel. In the industrial field of display devices such as a color cathode ray tube, etc., a combination of three fluorescence layers such as a red fluorescence layer, a green fluorescence layer and a blue fluorescence layer corresponding to the three primary colors of R (red), G (green) and B (blue) is called "pixel", and it is often used as a technical unit for a screen fineness. However, the unit fluorescence layer in the present invention differs from the above pixel. The above definition applies to display panels according to all the aspects of the present invention excluding the first aspect of the present invention and also applies to display devices according to all the aspects of the present invention excluding the first aspect of the present invention.

The power supply line may comprise a plurality of unit power supply lines and each unit power supply line is connected to each independent electrode. That is, each unit power supply line is so formed as to correspond to each independent electrode. Such a constitution will be referred to as "second-A constitution". Each unit power supply line can be connected to the anode electrode driving circuit by extending each unit power supply line on an idle region to a connecting terminal provided, for example, on one portion of a peripheral area of the display panel and by providing a line from the connecting terminal to the anode electrode driving circuit.

Further, a resistance member may be inserted somewhere in, for example, the middle of each unit power supply line. Such a constitution will be referred to as "second-B constitution". When a discharge takes place, the supply of energy from the anode electrode driving circuit can be temporarily discontinued by providing the resistance member. In the second-B constitution, for example, a chip resistor may be inserted, or a resistance film may be formed, as a resistance member somewhere in the middle of each unit power supply line on the idle region. The resistance value of the resistance member is set at a value which is small to such an extent that a voltage drop caused by an anode current during general display operation has almost no effect on the display brightness and which is large to such an extent that the supply of an energy to the anode electrode from the anode electrode driving circuit through the unit power supply line can be virtually shut off when a discharge of a small scale takes place. The above basic thought of dividing the anode electrode and using the resistance member applies also to a display panel and a display device according to a third aspect of the present invention which will be discussed later.

The display panel and the display device according to the second aspect of the present invention may have a constitution in which the independent electrodes are so arranged in a matrix form as to correspond to fluorescence layer groups consisting of a predetermined number of the unit fluorescence layers each, the power supply line has a main line and a plurality of branch lines branching from the main line, and all the independent electrodes included in columns or rows of the matrix are connected to the branch lines common to the columns or rows through resistance films. The above constitution will be referred to as "second-C constitution" hereinafter. The plane form of each independent electrode is not specially limited, while the plane form is preferably such that gaps between adjacent independent electrodes have no irregular sizes, in view of achieving a uniform brightness distribution in the effective region. The number of the branch lines branching from the main line and the branching direction thereof are not specially limited, either. However, the branch lines preferably have lengths which are as uniform as possible and uniform wiring resistances, in view of achieving a uniform brightness distribution in the effective region. Each branch line may further have a plurality of branch lines being branched therefrom.

In the second-C constitution, the number of the unit fluorescence layers constituting the fluorescence layer group corresponding to one independent electrode is not specially limited. From the viewpoint of a pixel unit of a color display device, one fluorescence layer group may contain the unit fluorescence layers to such a number that a plurality of the pixels can be constituted, or one fluorescence layer group may contain three unit fluorescence layers that can constitute one pixel. Further, one fluorescence layer group may contain one unit fluorescence layer. When one fluorescence layer group contains one unit fluorescence layer, there can be provided a constitution in which the electrostatic capacitance can be minimized in the display panel having an effective region of some finite size. In the display panel having the second-C constitution, preferably, the unit fluorescence layers are arranged in the form of a so-called dot matrix. The above description can also apply to a display panel having a third-A constitution according to a third aspect of the present invention.

In the display panel and the display device according to the second aspect of the present invention, the independent electrodes can be so arranged in the form of stripes as to correspond to the fluorescence layer group consisting of a plurality of the unit fluorescence layers. The above constitution will be referred to as "second-D constitution" hereinafter. The stripes may be extended in a length direction or a width direction when it is assumed that the effective region has a rectangular form. In the second-D constitution, preferably, the unit fluorescence layers are also arranged in the form of stripes. That is, in this constitution, the unit fluorescence layers for red (R) are arranged in one row to form a red fluorescence layer group, the unit fluorescence layers for green (G) are arranged in one row to form a green layer group, and the unit fluorescence layers for blue (B) are arranged in one row to form a blue fluorescence layer group. One independent electrode may correspond to one row of the fluorescence layer groups of one color, may correspond to a combination of three rows of the fluorescence layer groups of three primary colors, or may correspond to a plurality of combinations of three rows of the fluorescence layer groups of three primary colors. The above description can also apply to a display panel having a third-B constitution according to a third aspect of the present invention.

In the display panel and the display device according to the second aspect of the present invention, the independent electrodes and the power supply line can be composed of a common conductive material layer on the substrate. For example, a conductive material layer composed of a conductive material is formed on the substrate, and the conductive material layer is patterned, whereby the independent electrodes and the power supply line can be simultaneously formed. Otherwise, a conductive material is deposited or screen-printed through a mask or a screen having a pattern of the independent electrodes and the power supply line, whereby the independent electrodes and the power supply line can be simultaneously formed on the substrate. In the display panel having the second-C or second-D constitution, the resistance film can be also formed in the same manner as above. That is, a resistance film composed of a resistance material may be formed on the substrate and patterned to form the resistance member, or a resistance material may be deposited or printed through a mask or a screen having a resistance member pattern, to form the resistance film.

Even in a case where neither the resistance member nor the resistance film is formed on the display panel side, the resistance member(s) may be provided in the anode electrode driving circuit, and the power supply line can be connected to such an anode electrode driving circuit. When a discharge of a small scale takes place between the rear panel and the display panel, therefore, the supply of energy from the anode electrode driving circuit to the anode electrodes through the power supply line can be temporarily shut off to prevent the occurrence of a spark discharge.

The above second-A to second-D constitutions are based on the classification made, in a sense, in view of arrangements of the power supply line and the resistance member or the resistance film and of the formation pattern of the independent electrodes. The display panel and the display device according to the second aspect of the present invention can structurally include the following five cases (1) to (5). That is, (1) a case where the unit fluorescence layers are formed on the substrate and the independent electrodes are formed on the unit fluorescence layers, (2) a case where the independent electrodes are formed on the substrate and the unit fluorescence layers are formed on the independent electrodes, (3) a case where each of the independent electrodes comprises a lower electrode and an upper electrode, the lower electrode is formed on the substrate, the unit fluorescence layer is formed on the lower electrode, and the upper electrode is formed on the unit fluorescence layer and the lower electrode, (4) a case where each of the independent electrodes comprises a lower electrode and an upper electrode, the unit fluorescence layer is formed on the substrate, the lower electrode is formed on the unit fluorescence layer, and the upper electrode is formed on the lower electrodes, and (5) a case where the independent electrodes are formed on the substrate, the resistance film extends over onto the independent electrode, and the unit fluorescence layer (s) is (are) formed on the resistance film.

In the case (5), further, an adhesive layer may be formed between the resistance film and the independent electrode and/or between the resistance film and the unit fluorescence layer. In the cases (3) and (4) in which the independent electrodes comprise the upper electrodes and the lower electrodes, not only the second object of the present invention but also the first object of the present invention can be achieved.

In each of these cases (1) to (5), it is determined depending upon which material is used for forming the independent electrodes and the resistance member, a transparent material or non-transparent (reflective) material, whether the material constituting the substrate is transparent or non-transparent. As a consequence, it is determined whether the display device is a transmission type or a reflection type when the display panel is incorporated into the display device.

In view of the above conditions, the case (1) can be further classified into follows. Of these, the case (1-1) is the most excellent in the compatibility with an existing production process for the production of a display panel. That is, the independent electrodes and the power supply line can be constituted by utilizing a conventional conductive material layer used as a conductive reflective layer (corresponding to the metal-back layer of a cathode ray tube).

| Case | independent electrode | substrate | Type of display device |
|---|---|---|---|
| (1-1) | N-TP | TP | TR |
| (1-2) | TP | TP | TR or RF |
| (1-3) | TP | N-TP | RF |

In view of the above conditions, the case (2) can be further classified into follows. Of these cases, the case (2-2) is the most excellent in the compatibility with an existing production process for the production of a display panel. That is, the independent electrodes and the power supply line can be constituted by utilizing a conventional layer used as a transparent conductive layer.

| Case | independent electrode | substrate | Type of display device |
|---|---|---|---|
| (2-1) | N-TP | TP or N-TP | RF |
| (2-2) | TP | TP | TR or RF |
| (2-3) | TP | N-TP | RF |

The case (3) can be classified into (i-1) to (i-4) explained in the first aspect of the present nvention. Further, the case (4) can be classified into (ii-1) to (ii-4) explained in the first aspect of the present invention.

In view of the above conditions, the case (5) can be further classified into follows.

| Case | resistance film | independent electrode | substrate | Type of display device |
|---|---|---|---|---|
| (5-1) | N-TP | TP or N-TP | TP or N-TP | RF |
| (5-2) | TP | N-TP | TP or N-TP | RF |
| (5-3) | TP | TP | N-TP | RF |
| (5-4) | TP | TP | TP | TR or RF |

When the adhesive layer is formed between the resistance film and the independent electrode and/or between the resistance film and the fluorescence layer, there can be further many cases depending upon whether the adhesive layer is transparent or non-transparent. In these cases, however, the above discussion can apply to whether the display device is a transmission type or a reflection type. That is, when a transmission type display device is constituted, not only the substrate is required to be transparent, but also all the layers present between the fluorescence layer and the substrate are required to be transparent. When a reflection type display device is constituted, all the components for the rear panel present in the effective region are required to be transparent.

The display panel according to a third aspect of the present invention for achieving the above second object is a display panel comprising a substrate, a plurality of unit fluorescence layers which are to be caused to emit light by electrons from a vacuum space, and an anode electrode which is to direct the electrons toward the unit fluorescence layers, wherein the anode electrode comprises a plurality of independent electrodes so formed as to correspond to a predetermined number of the unit fluorescence layers, the display panel has a power supply layer formed on the substrate, an insulating layer formed on the power supply layer, the unit fluorescence layers formed on the power supply layer or the insulating layer, the independent electrodes formed on the unit fluorescence layers and the insulating layer, holes formed in the insulating layer, and resistance layers buried in the holes, and the independent electrode is connected to the power supply layer with the resistance layer.

The display device according to a third aspect of the present invention for achieving the above second object is a display device in which the display panel according to the third aspect of the present invention is used, wherein the display panel and a rear panel having a plurality of electron emitting members are arranged to be opposed to each other through a vacuum space, the display panel comprises a substrate, a plurality of unit fluorescence layers which are to be caused to emit light by electrons emitted from the electron emitting members into the vacuum space, and an anode electrode which is to direct the electrons toward the unit fluorescence layers, the anode electrode comprises a plurality of independent electrodes so formed as to correspond to a predetermined number of the unit fluorescence layers, the display panel has a power supply layer formed on the substrate, an insulating layer formed on the power supply layer, the unit fluorescence layers formed on the power supply layer or the insulating layer, the independent electrodes formed on the unit fluorescence layers and the insulating layer, holes formed in the insulating layer, and resistance layers buried in the holes, and the independent electrode is connected to the power supply layer with the resistance layer.

In the display panel and the display device according to the third aspect of the present invention, the power supply means for supplying a positive voltage to the independent electrodes from the anode electrode driving circuit is not a power supply "line" but a power supply "layer". In the display panel and the display device according to the third aspect of the present invention, the power supply means and the independent electrodes are three-dimensionally arranged through the insulating layer. Unlike the display panel and the display device according to the second aspect of the present invention, therefore, it is no longer necessary to figure out a layout of the power supply means and the independent electrodes in one plane, and the power supply means can be formed on the entire surface of the effective region. However, the power supply layer can have any predetermined pattern without any problem. In the display panel and the display device according to the third aspect of the present invention, a charge is removed from the unit fluorescence layers through both the power supply layer and the independent electrodes, so that the first object of the present invention can be also achieved.

In the display panel and the display device according to the third aspect of the present invention, when a plurality of the unit fluorescence layers are formed on the power supply layer, the unit fluorescence layers are in contact with both the power supply layer and the independent electrodes and are therefore required to have good insulating properties, while the display panel is advantageously decreased in thickness since the unit fluorescence layers and the insulating layer are formed nearly in the same plane. When a plurality of the unit fluorescence layers are formed on the insulating layer, it is not critical whether or not the unit fluorescence layers have good insulating properties.

In the display panel and the display device according to the third aspect of the present invention, there may be employed a constitution in which the independent electrodes are so arranged in a matrix form as to correspond to fluorescence layer groups consisting of a predetermined number of the unit fluorescence layers. The above constitution will be referred to as "third-A constitution" hereinafter. The number of the unit fluorescence layers constituting the unit fluorescence layer group corresponding to one independent electrode is not specially limited, and it may be one. In the display panel and the display device according to the third aspect of the present invention, there may be employed a constitution in which the independent electrodes are so arranged in the form of stripes as to correspond to fluorescence layer groups consisting of a plurality of the unit fluorescence layers. The above constitution will be referred to as "third-B constitution" hereinafter.

In the display panel according to the third aspect of the present invention, it is also determined depending upon which material is used for forming the independent electrodes, a transparent material or non-transparent (reflective) material, whether the material constituting the substrate is transparent or non-transparent. As a consequence, it is determined whether the display device is a transmission type or a reflection type when the display panel is incorporated into the display device. That is, when a plurality of the unit fluorescence layers are formed on the power supply layer, the same discussion as the discussion of the cases (i-1) to (i-4) can be made by replacing the upper electrode in the previous case (i) with the independent electrode and replacing the lower electrode in the previous case (i) with the power supply layer. When a plurality of the unit fluorescence layers are formed on the insulating layer, it is further required to consider whether the insulating layer is transparent or non-transparent. That is, when the independent electrodes are non-transparent, the substrate and all the layers present between the unit fluorescence layers and the substrate are required to be transparent, and a transmission type display panel can be constituted. When the independent electrodes are transparent, transmission type and reflection type display panels can be constituted if all of the substrate, the power supply layer and the insulating layer are transparent, and a reflection type display panel can be constituted if at least one of the above layers is non-transparent.

In the display device according to each of the first to third aspects of the present invention, a cold cathode field emission device (to be referred to as "field emission device" hereinafter) is preferred as an electron emitting member. The type of the field emission device is not specially limited, and it can be any one of a Spindt type field emission device, an edge type field emission device, a flat type field emission device, a low-profile type field emission device and a crown type field emission device. Generally, the electron emitting member(s) is arranged in a region where each of projection images of a first electrode group extending in one direction in which scanning signals are inputted and a second electrode group extending in the other direction in which video signals are inputted overlaps each other. In the display device according to each of the second and third aspects of the present invention, preferably, the independent electrodes are arranged in the form of stripes and extend in a direction nearly in parallel with the direction of the second electrode group for achieving the third object of the present invention to prevent a variability of brightness in a display screen caused depending upon the number of selected electrodes of the second electrode group. When the first electrode group comprises gate electrodes, the second electrode group comprises cathode electrodes. When the first electrode group comprises cathode electrodes, the second electrode group comprises gate electrodes.

As a field emission device, a device called a surface conductive type electron emission device is also known in addition to the above types and can be applied to the display device according to any one of the first to third aspects of the present invention. The surface conductive type electron emission device has a constitution in which thin layers of tin oxide ($SnO_2$), gold (Au), indium oxide ($In_2O_3$)/tin oxide ($SnO_2$) or palladium oxide (PdO) having a very small area are formed on a substrate composed, for example, of glass and in the form of a matrix, each thin layer comprises two thin layer pieces, a column-direction wiring is connected to one thin layer piece and a row-direction wiring is connected to the other thin layer piece. There is provided a gap of several nano meter between one thin layer piece and the other thin layer piece. The thin layer selected with the column-direction wiring and the row-direction wiring emits electrons through the gap. When the first electrode group comprises the column-direction wirings, the second electrode group comprises the row-direction wirings. When the first electrode group comprises the row-direction wirings, the second electrode group comprises the column-direction wirings.

In the display panel and the display device according to all the aspects of the present invention, the substrate can be any substrate so long as the surface thereof comprises an insulation member. The substrate includes a glass substrate, a glass substrate having a surface on which an insulating film is formed, a quartz substrate, a quartz substrate having a surface on which an insulating film is formed and a semiconductor substrate having a surface on which an insulating film is formed. The substrate is not necessarily required to be transparent when it is used for constituting a reflection type display panel and a reflection type display device. Each of the above substrates may be used for constituting a supporting member for the rear panel.

Examples of materials for constituting the independent electrode, the power supply line, the power supply layer, the lower electrode, the upper electrode, the first electrode group and the second electrode group include metals such as tungsten (W), niobium (Nb), tantalum (Ta), molybdenum (Mo), chromium (Cr), aluminum (Al), copper (Cu), gold (Au), silver (Ag), titanium (Ti) and nickel (Ni), alloys or compounds of these metal elements (e.g., nitrides such as TiN and silicides such as $WSi_2$, $MoSi_2$, $TiSi_2$ and $TaSi_2$), conductive metal oxides such as ITO (indium-tin oxide), indium oxide and zinc oxide, and semiconductor such as silicon. When the above members are formed, a thin layer of the above material is formed on a substratum by a known thin film forming method such as a chemical vapor deposition method, a sputtering method, a vapor deposition method, an ion plating method, an electroplating method, an electroless plating method, a screen-printing method, a laser abrasion method or a sol-gel method. When the thin film is formed on the entire surface of a substratum, the thin film is patterned by a known patterning method to form each member. Each member can be formed by a lift-off method by forming a resist pattern on the substratum prior to the formation of the thin film. Further, the patterning after the formation of the layer is not required if the vapor deposition is carried out with a mask having openings corresponding to the form of the independent electrode or the power supply line or screen-printing is carried out through a screen having the above openings.

Typical examples of the material for constituting the resistance film or the resistance layer include carbon-containing materials, semiconductor materials such as amorphous silicon and refractory metal oxides such as tantalum oxide. The resistance film can be formed by the same method as the method of forming the above members such as the independent electrode and the power supply line. The pattern width and thickness of the resistance film are determined such that the resistance value is small to such an extent that a voltage drop caused by an current flowing from the display panel toward the rear panel during general display operation has almost no effect on the display brightness and that the resistance value is large to such an extent that the supply of energy to the anode electrode from the anode electrode driving circuit through the power supply line or the power supply layer can be virtually shut off when a discharge of a small scale takes place. The resistance value can be set between several tens kΩ and several hundreds MΩ. This resistance value can also apply to the resistance member such as a chip resistor. As a typical material for constituting the adhesive layer, titanium (Ti) can be used.

In the display panel and the display device according to the third aspect of the present invention, the material for constituting the insulating layer includes $SiO_2$, SiN, SiON, SOG (spin on glass) and a glass paste cured product. These materials can be used alone or in combination. The insulating layer can be formed by a known method such as a chemical vapor deposition method, an application method, a sputtering method or a screen-printing method. The above materials and the above method can be applied to the formation of the insulating interlayer which is a component of the cold cathode field emission device.

BRIEF DESCRIPTION OF THE DRAWINGS

The present invention will be explained hereinafter with reference to Examples by referring to drawings.

FIG. 23C is a schematic partial cross-sectional view of a crown type cold cathode field emission device.

DESCRIPTION OF THE PREFERRED EMBODIMENTS

EXAMPLE 1

Figure 1A:
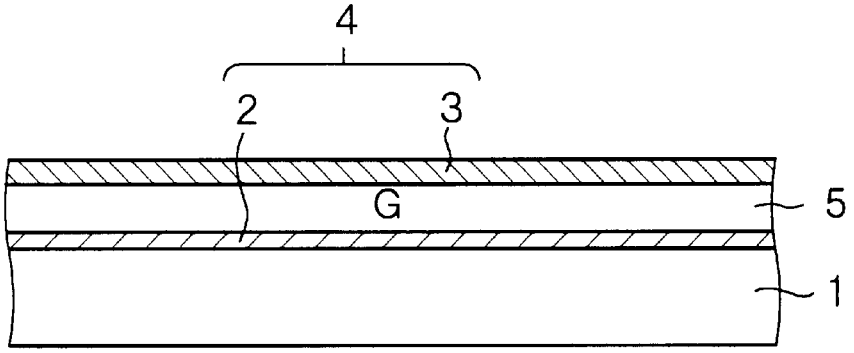
FIGS. 1A, 1B and 1C are schematic partial cross-sectional views of display panels having an anode electrode having a two-layered structure in Example 1.
Figure 1B:
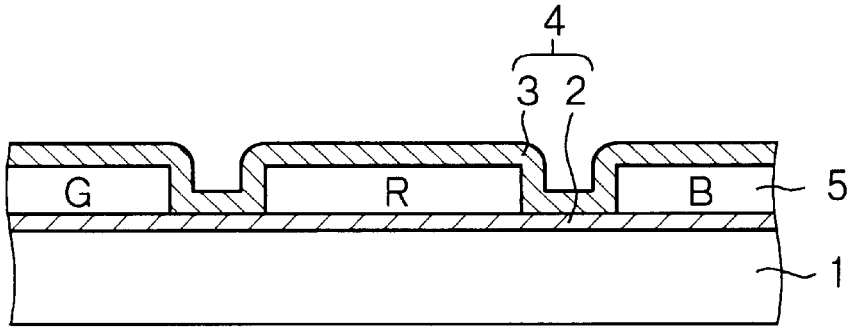
Figure 1C:
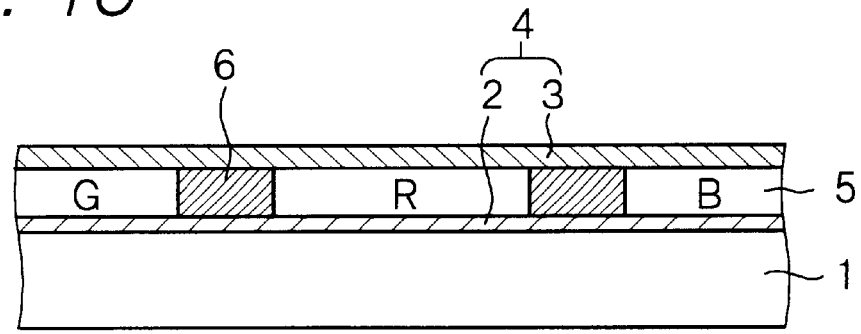
Figure 3:
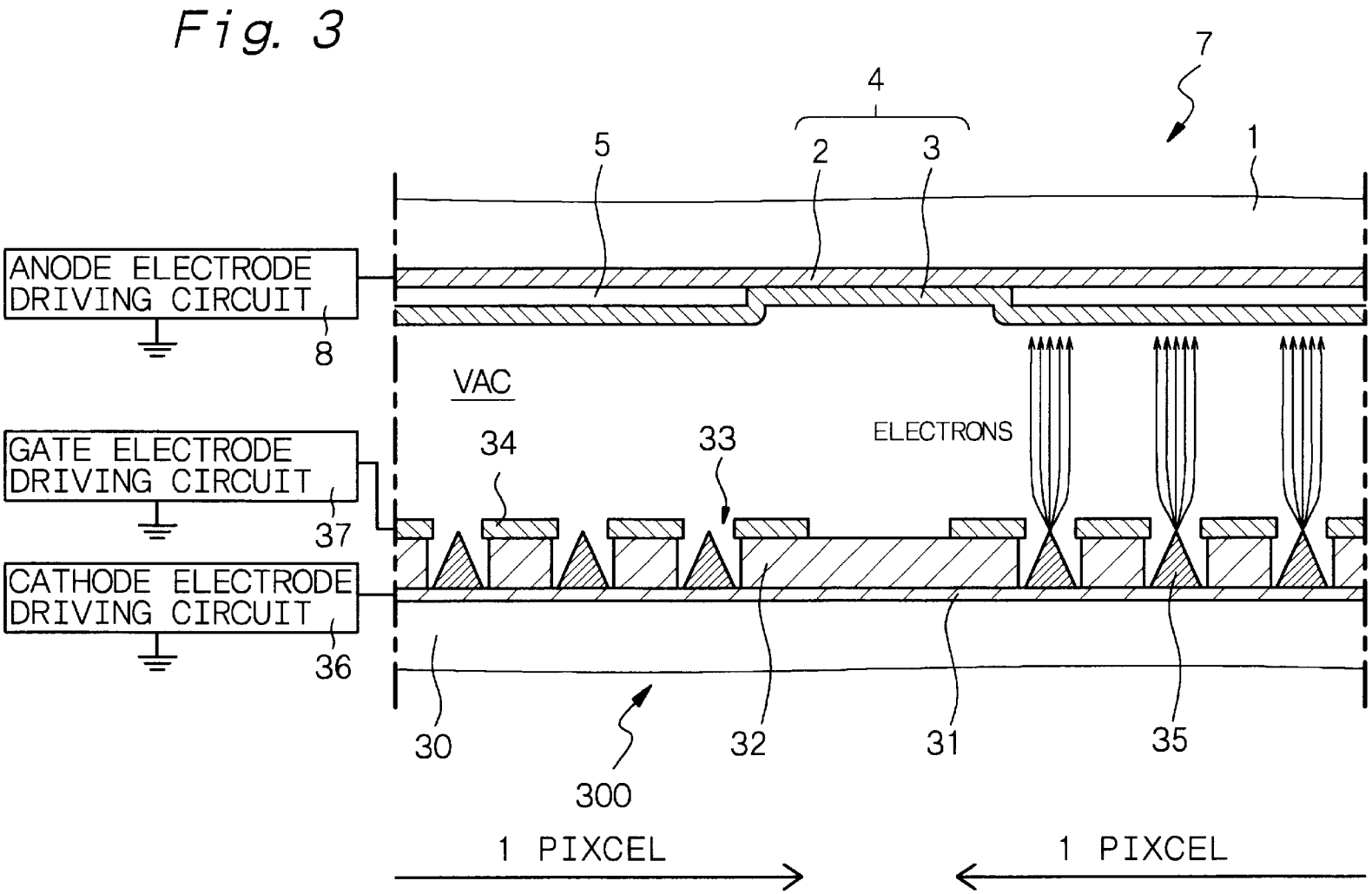
FIG. 3 shows a conceptual view of the display device of Example 1.
Figure 4A:
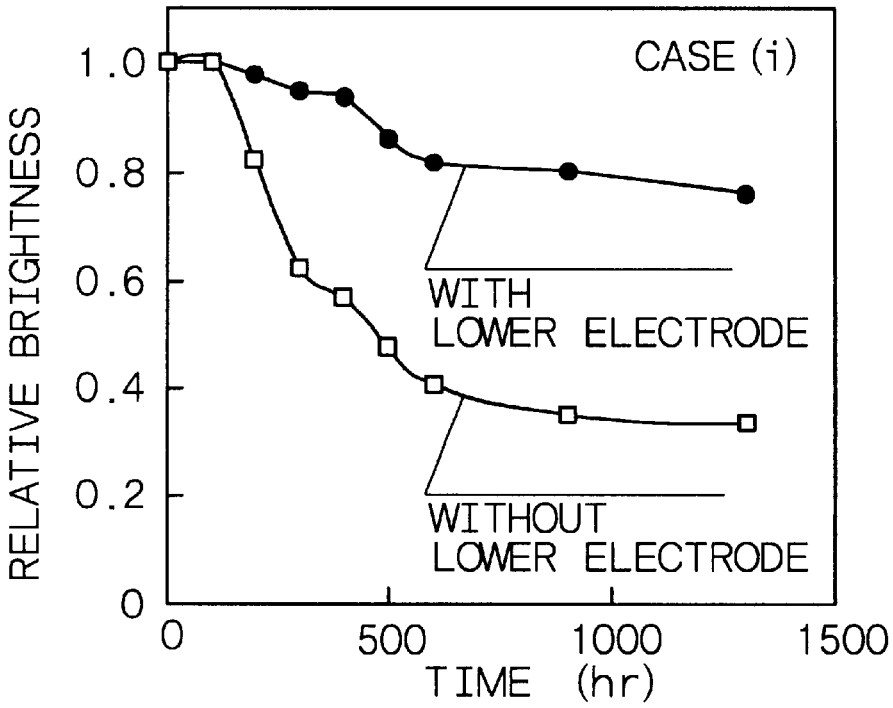
FIGS. 4A and 4B are graphs showing brightness lifetime characteristics of the display devices of Example 1.
Figure 4B:
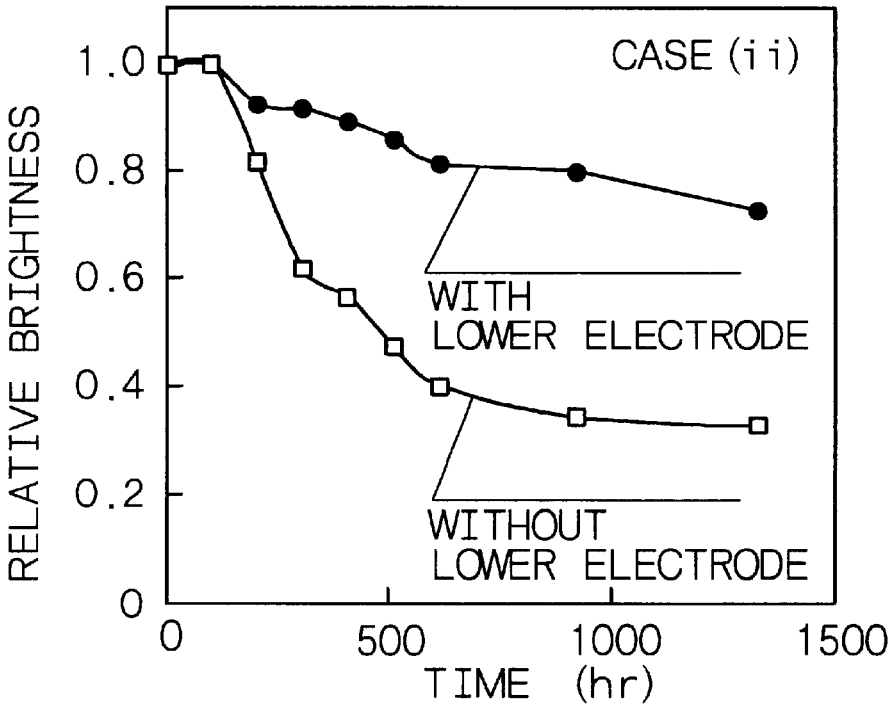

Example 1 is concerned with a display panel and a display device according to the first aspect of the present invention. FIGS. 1A to 1C show schematic partial cross-sectional views of the display panels of the case (i), FIGS. 2A to 2C show schematic partial cross-sectional views of the display panels of the case (ii), FIG. 3 shows a conceptual view of the display device, and FIGS. 4A and 4B show brightness lifetime characteristics of the display devices.

FIGS. 1A to 1C show configuration examples of three types of the display panels belonging to the case (i). An anode electrode 4 comprises a lower electrode 2 and an upper electrode 3, the lower electrode 2 is formed on a substrate 1, a fluorescence layer 5 is formed on the lower electrode 2, and the upper electrode 3 is formed on the fluorescence layer 5. The display panel shown in FIG. 1A is intended to be a display panel for monochromatic displaying, and the fluorescence layer for emitting light, for example, of green (G) is formed on the entire surface of an effective region. The lower electrode 2 and the upper electrode 3 are electrically connected to each other on a region (not shown), for example, in a peripheral portion of the effective region. The display panel shown in FIG. 1B is intended to be a display panel for full color displaying, and the fluorescence layers 5 for emitting light of red (R), green (G) and blue (B), respectively, are formed in a predetermined pattern. The upper electrode 3 is so formed on the fluorescence layers 5 as to reach the surface of the lower electrode 2. FIG. 1C shows a display panel formed by modifying the display panel shown in FIG. 1B by filling gaps between the fluorescence layer 5 and the fluorescence layer 5 with a black-matrix layer 6. The upper electrode 3 is formed on the fluorescence layers 5 and the black-matrix layer 6. The lower electrode 2 and the upper electrode 3 are electrically connected to each other on a region (not shown), for example, in a peripheral portion of the effective region. In the display panel for monochromatic displaying, the fluorescence layer 5 may be formed in a predetermined pattern, or further, gaps between the fluorescence layer 5 and the fluorescence layer 5 may be filled with a black-matrix layer 6.

The display panel shown in FIG. 1A is manufactured as follows. First, the lower electrode 2 of ITO having a thickness of approximately 0.01 to 0.5 $\mu$m, preferably, approximately 0.05 to 0.2 $\mu$m (typically, approximately 0.05 $\mu$m) is formed on the entire surface of the effective region on the substrate 1 composed, for example, of glass, by a sputtering method or a sol-gel method. Then, the fluorescence layer 5 is formed on the lower electrode 2 by a screen-printing method or a slurry method. When the screen-printing method is used, a fluorescence composition containing fluorescence particles is screen-printed on the lower electrode 2, followed by drying and sintering, whereby the fluorescence layer 5 can be formed. When the slurry method is used, a slurry containing fluorescence particles and a photo-sensitive polymer is applied onto the lower electrode 2 to form a coating, and the photo-sensitive polymer is insolubizied to a developer solution by exposure, whereby the fluorescence layer 5 can be formed. Then, the upper electrode 3 of aluminum (Al) is formed as a layer having a thickness of approximately 0.01 to 0.5 $\mu$m, preferably, approximately 0.05 to 0.1 $\mu$m (typically, approximately 0.1 $\mu$m), for example, by a sputtering method. As a material for the upper electrode 3, the aluminum may be replaced with nickel (Ni) or silver (Ag). When the display panel shown in FIG. 1B is manufactured, the fluorescence layer can be formed by a screen-printing method or a slurry method which consecutively uses three fluorescence compositions or slurries containing $Y_2O_2S$:Eu as fluorescence particles for emitting red light, ZnS:Cu,Al as fluorescence particles for emitting green light and ZnS:Ag,Al or ZnS:Ag,Cl as fluorescence particles for emitting blue light. Further, when the display panel shown in FIG. 1C is manufactured, the black-matrix layer 6 is formed on the lower electrode 2, and then the fluorescence layer 5 can be formed by a screen-printing method or a slurry method consecutively using the three fluorescence compositions or slurries.

Figure 2A:
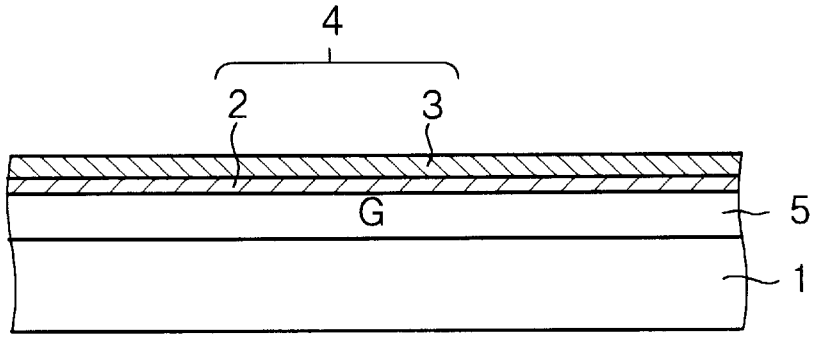
FIGS. 2A, 2B and 2C are schematic partial cross-sectional views of other display panels having an anode electrode having a two-layered structure in Example 1.
Figure 2B:
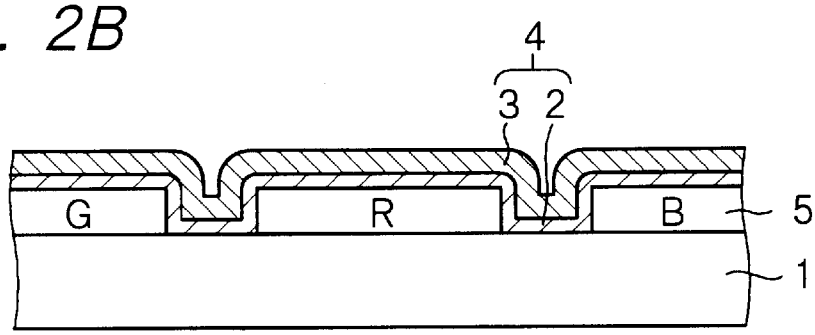
Figure 2C:
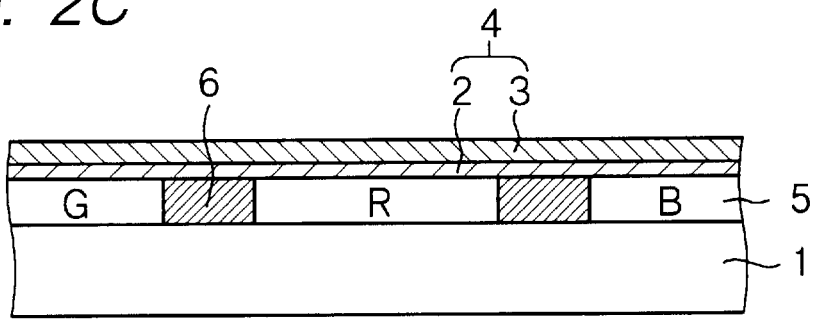

FIGS. 2A to 2C show configuration examples of three types of the display panels belonging to the case (ii). An anode electrode 4 comprises a lower electrode 2 and an upper electrode 3, a fluorescence layer 5 is formed on a substrate 1, the lower electrode 2 is formed on the fluorescence layer 5, and the upper electrode is formed on the lower electrode 2. The display panel shown in FIG. 2A is intended to be a display panel for monochromatic displaying, and the fluorescence layer 5 for emitting light, for example, of green (G) is formed on the entire surface of an effective region. The display panel shown in FIG. 2B is intended to be a display panel for full color displaying, and the fluorescence layers 5 for emitting light of red (R), green (G) and blue (B), respectively, are formed in a predetermined pattern. The lower electrode 2 is so formed on the fluorescence layers 5 as to reach the surface of the substrate 1. FIG. 2C shows the display panel formed by modifying the display panel shown in FIG. 2B by filling gaps between the fluorescence layer 5 and the fluorescence layer 5 with a black-matrix layer 6. The lower electrode 2 is formed on the fluorescence layers 5 and the black-matrix layer 6. In the display panel for monochromatic displaying, the fluorescence layer 5 may be formed in a predetermined pattern, or further, gaps between the fluorescence layer 5 and the fluorescence layer 5 may be filled with a black-matrix layer 6.

The display panel shown in FIG. 2A can be manufactured as follows. First, the fluorescence layer is formed on the entire surface of an effective region on the substrate 1 composed, for example, of glass, by a screen-printing method or a slurry method. Then, the lower electrode 2 of ITO having a thickness of approximately 0.05 $\mu$m is formed on the fluorescence layer 5 by a sputtering method or a sol-gel method. Then, the upper electrode 3, for example, of aluminum having a thickness of approximately 0.1 $\mu$m is formed on the lower electrode 2 by a sputtering method. When the display panel shown in FIG. 2B is manufactured, the fluorescence layers 5 can be formed by a screen-printing method or a slurry method consecutively using three fluorescence compositions or three slurries corresponding to three primary colors. When the display panel shown in FIG. 2C is manufactured, the black-matrix layer 6 is formed on the substrate 1, and then the fluorescence layers 5 can be formed by a screen-printing method or a slurry method consecutively using the three fluorescence compositions or slurries.

FIG. 3 shows a configuration example of the display device using the display panel shown in FIG. 1B. In the display device, the display panel 7 and a rear panel 300 are arranged to be opposed to each other, and these panels 7 and 300 are bonded to each other in circumferential end portions through a frame (not shown) to form a closed space between the panels 7 and 300 as a vacuum space VAC. The rear panel 300 has cold cathode field emission devices (to be referred to as "field emission devices" hereinafter) as electron emitting members. In FIG. 3, so-called Spindt type field emission devices having conical electron emitting portions 35 are shown as an example of the field emission device. Each Spindt type field emission device comprises a cathode electrode 31 formed on a supporting member 30, an insulating interlayer 32 formed on the cathode electrode 31 and the supporting member 30, a gate electrode 34 formed on the insulating interlayer 32, and the conical electron emitting portion 35 formed in an opening portion 33 formed in the gate electrode 34 and the insulating interlayer 32. In FIG. 3, a plurality of the electron emitting portions 35 correspond to one unit fluorescence layer 5. The electron emitting portions 35 have a very small structure, and in some actual cases, several hundreds to several thousands electron emitting portions 35 are provided per pixel. A relatively negative voltage (video signal) is applied to the electron emitting portions 35 from a cathode electrode driving circuit 36 through the cathode electrode 31, and a relatively positive voltage (scanning signal) is applied to the gate electrode 34 from a gate electrode driving circuit 37. Electrons are emitted from the tips of the electron emitting portions 35 depending upon an electric field generated by the application of the above voltages. A positive voltage higher than the positive voltage applied to the gate electrode 34 is applied to the lower electrode 2 of the display panel 7 from an anode electrode driving circuit 8, so that the electrons emitted from the electron emitting portions 35 are directed toward the fluorescence layer 5. The electron emitting member is not limited to the above Spindt type field emission device, and it can be also selected from field emission devices of other types such as a so-called edge type field emission device, a flat type field emission device, a low-profile type field emission device and a crown type field emission device.

The display panels shown in FIGS. 1A and 1C and FIGS. 2A to 2C can be also used for constituting display devices. Further, in the explanations, the lower electrode 2 is composed of transparent ITO, the upper electrode 3 is composed of non-transparent (reflective) aluminum, and the substrate 1 is composed of glass, so that the display device is constituted as a transmission type. However, a reflection type display device or transmission type display device can be constituted depending upon some materials for constituting the above members. Configuration examples thereof will be explained later in Example 2.

FIGS. 4A and 4B show brightness lifetime characteristics of the above display devices. FIG. 4A shows brightness lifetime characteristics of the display device into which the display panel of the case (i) shown in FIG. 1B is incorporated and a display device into which the same display panel manufactured in the same manner as above except for the formation of the lower electrode 2 is incorporated. FIG. 4B shows brightness lifetime characteristics of the display device into which the display panel of the case (ii) shown in FIG. 2B is incorporated and a display device into which the same display panel manufactured in the same manner as above except for the formation of the lower electrode 2 is incorporated. The above display devices are measured under conditions of 6 kilovolts of acceleration voltage and 10 $\mu A/cm^2$ of a current density. When no lower electrode 2 is formed, the brightness sharply decreases near to a finally stabilized level in the first 500 hours after initiation of the measurement, and the finally stabilized level decreases to less than 40% of the value found immediately after initiation of the measurement. When the lower electrode 2 is formed, both the display devices into which the display panels of the cases (i) and (ii) are incorporated show a moderate decrease in the brightness, and even after 1300 hours after initiation of the measurement, clearly, the display devices keep approximately 80% of the brightness value found immediately after initiation of the measurement.

EXAMPLE 2

Figure 5A:
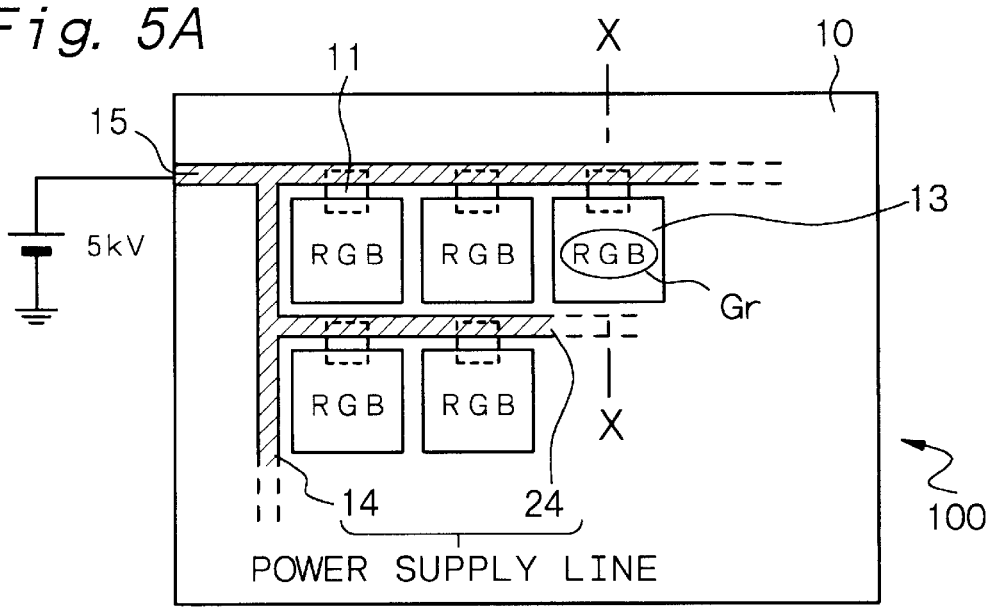
FIG. 5A is a schematic partial plan view and FIGS. 5B, 5C, 5D and 5E are schematic partial cross-sectional views of display panels of Example 2 in which independent electrodes are arranged in a matrix form.

Example 2 is concerned with a display panel according to the second-C constitution and a display device according to the second aspect of the present invention. FIG. 5A is a schematic partial plan view and FIGS. 5B to 5E and FIGS. 6A to 6D are schematic partial cross-sectional views of the display panels of Example 2. FIG. 7 shows a conceptual view of the display device. FIGS. 8A to 8C, FIGS. 9A to 9D, FIGS. 10A to 10E and FIGS. 11A to 11D show patterns of combinations of an independent electrode and a substrate.

In a display panel 100 of Example 2, an anode electrode comprises a plurality of independent electrodes 13 so formed as to correspond to a predetermined number of unit fluorescence layers as shown in FIG. 5A. A plurality of these independent electrodes 13 are arranged as a whole to nearly cover the effective region. A power supply line is formed on a rectangular substrate 10 composed, for example, of glass, and the power supply line comprises one main line 14 extending in the width direction of the substrate 10 and a plurality of branch lines 24 extending in parallel with the length direction of the rectangular substrate 10 (column direction). Each independent electrode 13 is connected to the power supply line through a resistance film 11. More specifically, the independent electrodes 13 forming one column are connected to one common branch line 24 extending in the column direction, and the independent electrodes 13 forming another column are connected to another common branch line 24. The main line 14 is connected to a connecting terminal (not shown) through a lead portion 15, and the connecting terminal is connected to an anode electrode driving circuit. In FIG. 5A, the anode electrode driving circuit is shown by a symbol of a power source (5 kV) for simplification. Each independent electrode 13 has a rectangular form as an example, and each independent electrode 13 is so formed as to correspond to a fluorescence layer group Gr consisting of three unit fluorescence layers 12R, 12G and 12B. The unit fluorescence layer 12R emits red light, the unit fluorescence layer 12G emits green light, and the unit fluorescence layer 12B emits blue light, so that the above fluorescence layer group Gr corresponds to one pixel of a general full color display device. The number of the unit fluorescence layers constituting the fluorescence layer group Gr shall not be limited to 3.

Figure 5B:
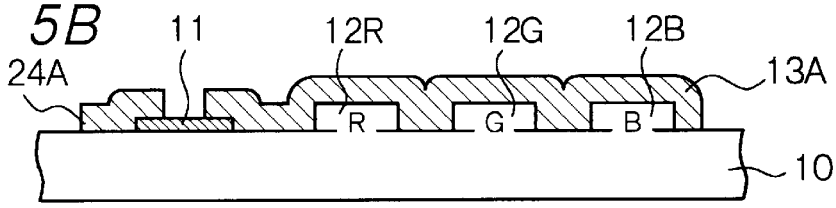
Figure 5C:
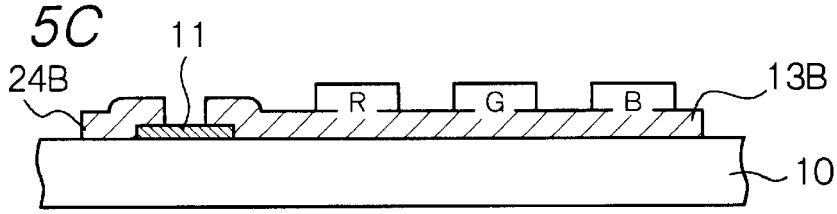
Figure 5D:
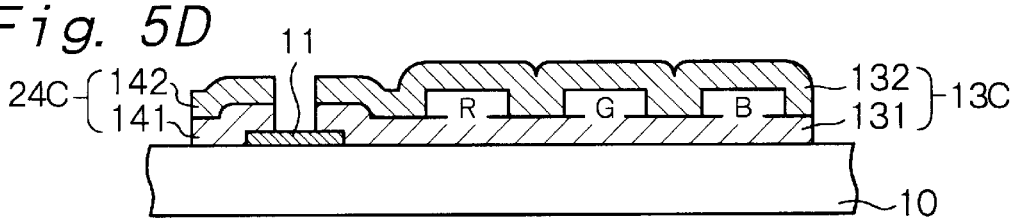
Figure 5E:
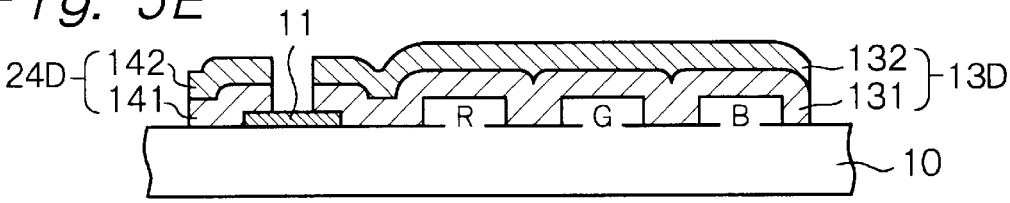

The display panel 100 shown in FIG. 5A includes eight structural cases shown in FIGS. 5B to 5E and FIGS. 6A to 6D depending upon constitutions of the independent electrodes. FIGS. 5B to 5E and FIGS. 6A to 6D shows partial cross-sectional views taken along an X—X line in FIG. 5A. The constitution shown in FIG. 5B corresponds to the case (1) where the unit fluorescence layers 12R, 12G and 12B are formed on the substrate 10 and an independent electrode 13A is formed on the unit fluorescence layers 12R, 12G and 12B. The case (1) is the most highly consistent with an existing production process when only a conductive reflective layer typified by a metal-back layer is used for constituting the independent electrode 13A. The constitution shown in FIG. 5C corresponds to the case (2) where an independent electrode 13B is formed on the substrate 10 and the unit fluorescence layers 12R, 12G and 12B are formed on the independent electrode 13B. The case (2) is the most highly consistent with an existing production process when a transparent conductive layer typified by an ITO layer is used for constituting the independent electrode 13B. The constitution shown in FIG. 5D corresponds to the case (3) where an independent electrode 13C comprises a lower electrode 131 and an upper electrode 132, the lower electrode 131 is formed on the substrate 10, the unit fluorescence layers 12R, 12G and 12B are formed on the lower electrode 131, and the upper electrode 132 is formed on the unit fluorescence layers 12R, 12G and 12B and the lower electrode 131. The case (3) corresponds to the constitution where the anode electrode is divided into a plurality of independent regions in the case (i) in the first aspect of the present invention. FIG. 5E corresponds to the case (4) where an independent electrode 13D comprises a lower electrode 131 and an upper electrode 132, the unit fluorescence layers 12R, 12G and 12B are formed on the substrate 10, the lower electrode 131 is formed on the unit fluorescence layers 12R, 12G and 12B, and the upper electrode 132 is formed on the lower electrode 131. The case (4) corresponds to the constitution in which the anode electrode is divided into a plurality of independent regions in the case (ii) in the first aspect of the present invention.

Figure 6A:
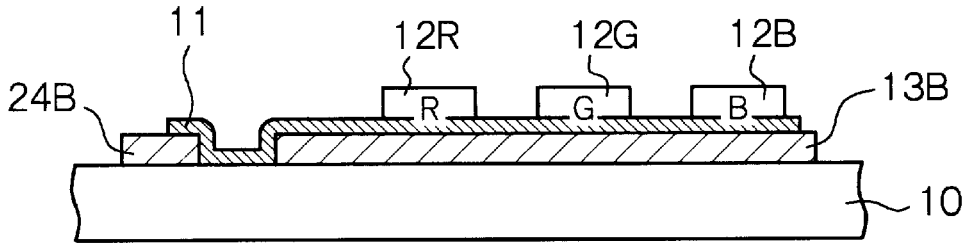
FIGS. 6A, 6B, 6C and 6D are schematic partial cross-sectional views of other display panels taken along X—X line in FIG. 5A.
Figure 6B:
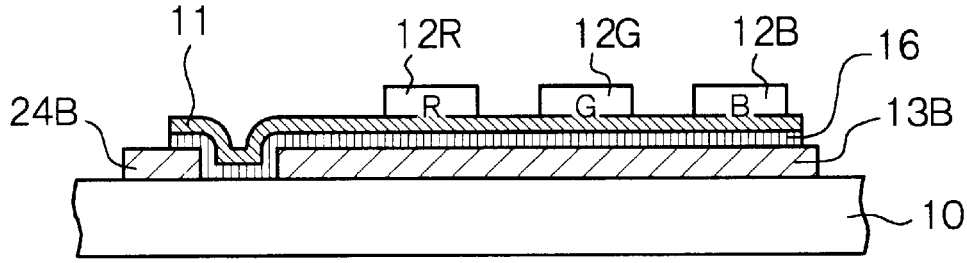
Figure 6C:
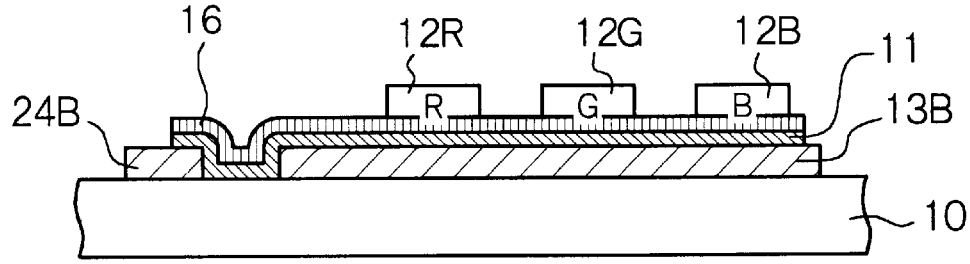
Figure 6D:
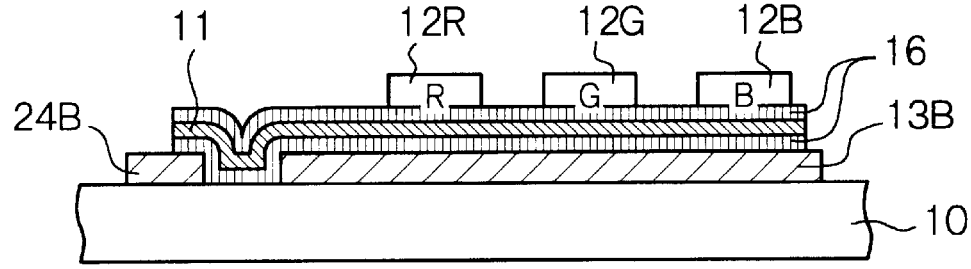
Figure 7:
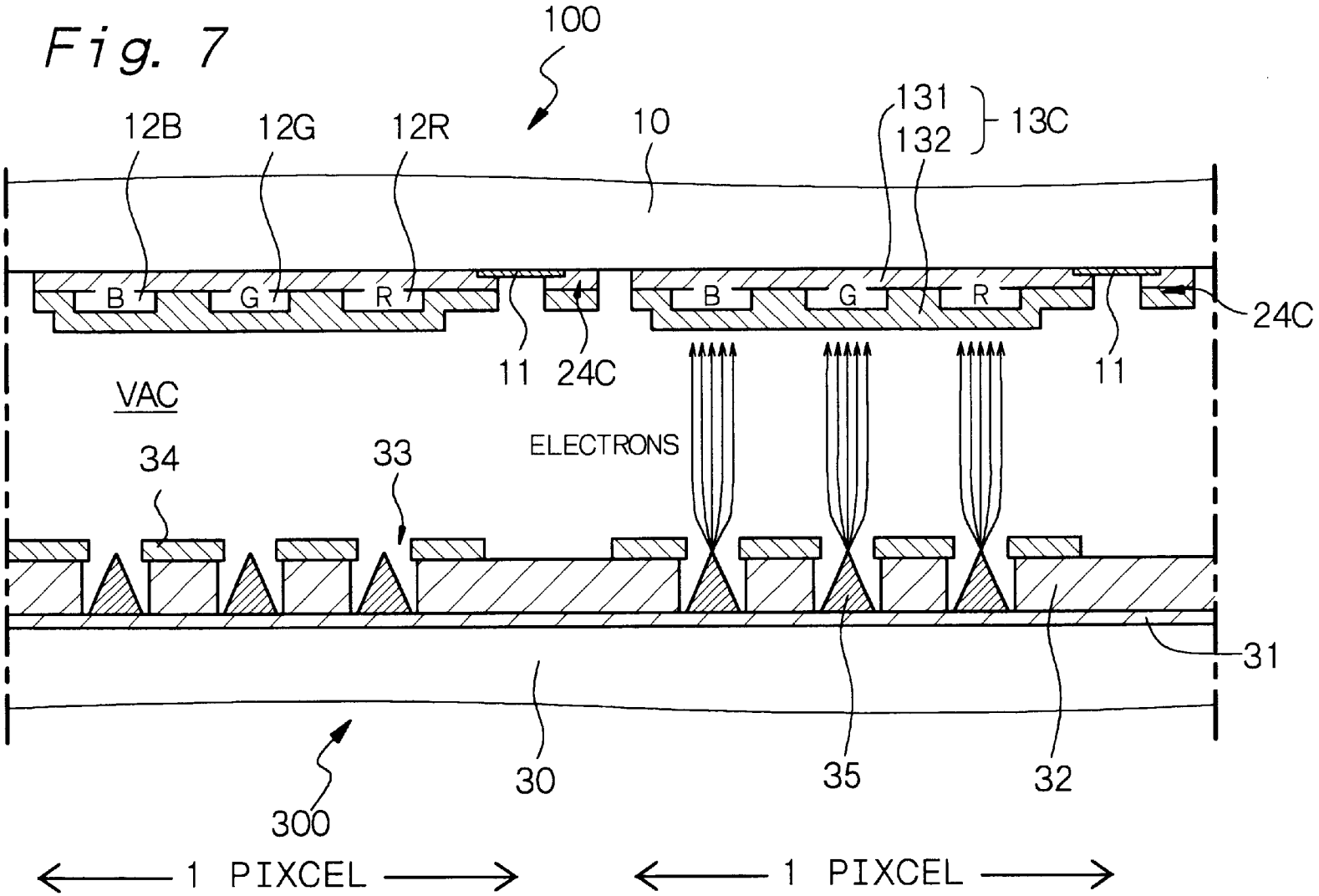
FIG. 7 is a conceptual view of the display device of Example 2.

The constitution shown in FIG. 6A corresponds to the case (5) where an independent electrode 13B is formed on the substrate 10, a resistance film 11 is extended onto the independent electrode 13B, and the unit fluorescence layers 12R, 12G and 12B are formed on the resistance film 11. FIG. 6B shows an embodiment in which an adhesive layer 16 is formed between the resistance film 11 and the independent electrode 13B in the case (5). FIG. 6C shows an embodiment in which an adhesive layer 16 is formed between the resistance film 11 and the unit fluorescence layers 12R, 12G and 12B in the case (5) Further, FIG. 6D shows an embodiment in which an adhesive layer is formed between the resistance film 11 and the independent electrode 13B and an adhesive layer is formed between the resistance film 11 and the unit fluorescence layers 12R, 12G and 12B in the case (5).

In the constitutions shown in FIGS. 5B, 5D and 5E, when a conductive reflective layer composed of a metal such as aluminum is used for forming the independent electrode 13A and the upper electrode 132, typically, the independent electrode 13A and the upper electrode 132 can be formed by a vapor deposition method using a metal mask. In the constitutions shown in FIGS. 5C to 5E and FIGS. 6A to 6D, when a transparent conductive layer is used for forming the independent electrode 13B and the lower electrode 131, typically, the independent electrode 13B and the lower electrode 131 can be formed by forming a layer of a transparent conductive material on the entire surface and patterning the layer.

Meanwhile, in FIG. 5B, a branch line 24A and the independent electrode 13A are composed of the same conductive material layer. In FIG. 5C and FIGS. 6A to 6D, further, a branch line 24B and the independent electrode 13B are composed of the same conductive material layer. Further, in FIGS. 5D and 5E, the lower electrode 141 constituting branch lines 24C and 24D and the lower electrode 131 constituting independent electrode 13C and 13D are composed of the same conductive material layer, and the upper electrode 142 constituting the branch lines 24C and 24D and the upper electrode 132 constituting the independent electrodes 13C and 13D are composed of the same conductive material layer. Further, the main line 14 and the lead portion can be composed of the same conductive material layer as that of the independent electrodes 13A, 13B, 13C and 13D in these cases. That is, the independent electrode, the power supply line and the lead portion can be simultaneously formed.

In the constitutions shown in FIGS. 5B to 5E, the resistance film 11 is formed on the substrate 10 first, and then the independent electrode 13A or 13B or the lower electrode 131 is formed. The order of the formation of these members may be reversed. That is, after the independent electrode and the power supply line are formed, the resistance film 11 may be so formed as to connect the branch line of the power supply line and the independent electrode. Further, in the constitutions shown in FIGS. 5D and 5E, the resistance film 11 may be formed after the upper electrode 132 is formed, or it may be formed after the lower electrode 131 or 141 is formed and before the upper electrode 132 or 142 is formed.

FIG. 7 shows a configuration of the display panel using the display panel 100 of FIG. 5D as an example. In the display device, the display panel 100 and the rear panel 300 are arranged to be opposed to each other, and these two panels 100 and 300 are bonded to each other in circumferential end portions through a frame (not shown) to form a closed space between these panels 100 and 300 as a vacuum space VAC. The rear panel 300 has the field emission devices. In FIG. 7, the Spindt type field emission devices having conical electron emitting portions 35 are shown as field emission devices. The electron emitting member is not limited to the above Spindt type field emission device, and it can be also selected from field emission devices of other types such as a so-called edge type field emission device, a flat type field emission device, a low-profile type field emission device and a crown type field emission device. Further, a different type field emission device such as a surface conductive type electron emitting device is used in some cases.

The constitution of the display device of Example 2 corresponds to a constitution in which the anode electrode is formed as divided portions instead of being formed on the entire surface of the effective region and each anode electrode is decreased in area. As a result, the electrostatic capacitance between the anode electrode (independent electrode 13 in Example 2) and the rear panel 300 is decreased, and energy stored or accumulated in the electrostatic capacitance can be no longer any energy which causes a discharge or causes it to continue. Further, each independent electrode 13 is connected to the anode electrode driving circuit not directly but through the resistance element 11, so that the growth of a discharge of a small scale, if any, to a spark discharge can be prevented. In a low voltage type display device in which the gap between the display panel and the rear panel is relatively small, therefore, a high voltage can be applied to the anode electrode stably, so that the low brightness which is a disadvantage of the low voltage type can be overcome with retaining other inherent advantages of the low voltage type.

Figure 8A:
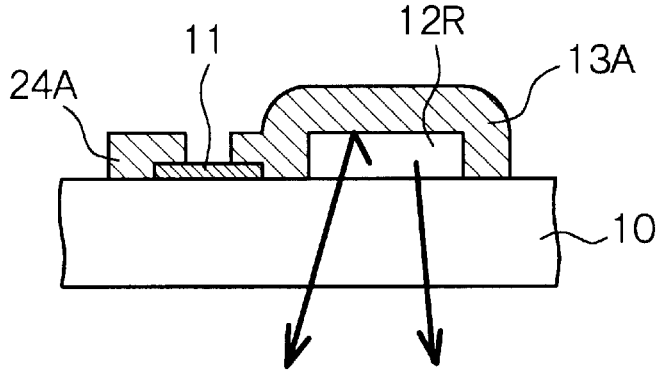
FIGS. 8A, 8B and 8C are schematic partial cross-sectional views showing combinations of materials constituting an independent electrode and a substrate.
Figure 8B:
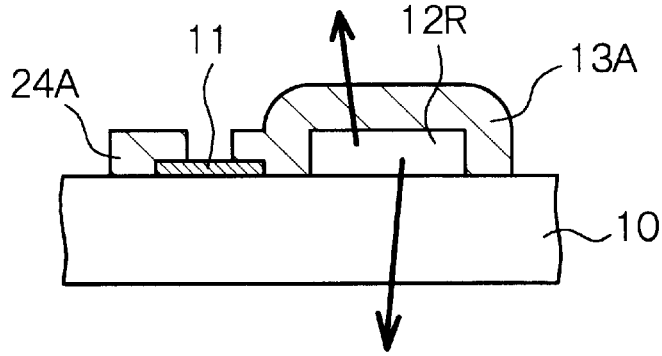
Figure 8C:
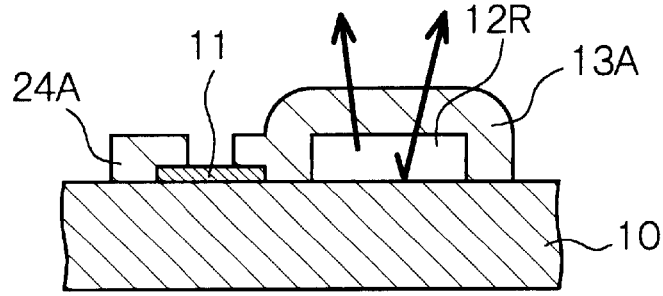

In the display panels 100 shown in FIGS. 5B to 5E and FIG. 6A, the transmission or reflection type of the display device is finally obtained depending upon the combinations of transparent and/or non-transparent (reflective) materials used for constituting the independent electrode 13A, 13B, 13C or 13D, the resistance film 11 and the substrate 10. The above combinations will be explained with reference to FIGS. 8A to 8C, FIGS. 9A to 9D, FIGS. 10A to 10E and FIGS. 11A to 11D. FIGS. 8A to 8C show the combinations in the display panel shown in FIG. 5B, FIGS. 9A to 9D show the combinations in the display panel shown in FIG. 5C, FIGS. 10A to 10E show the combinations in the display panel shown in FIG. 5D, and FIGS. 11A to 11D show the combinations in the display panel shown in FIG. 6A. In FIGS. 8A to 11D, the unit fluorescence layer 12R alone is shown and showing of the unit fluorescence layers 12G and 12B are omitted for simplification.

The combination shown in FIG. 8A corresponds to the case (1) in which the independent electrode 13A formed on the unit fluorescence layer 12R is composed of a non-transparent material such as a conductive reflective layer. In this case, the display panel 100 can be obtained only when the substrate 10 is transparent, and a display device using the display panel shown in FIG. 8A is inevitably a transmission type. In contrast, when the independent electrode 13A is composed of a transparent conductive layer such as an ITO layer, the substrate 10 can be transparent or can be non-transparent. That is, when the substrate 10 is transparent as shown in FIG. 8B, a transmission or reflection type display panel is constituted, and when the substrate 10 is non-transparent as shown in FIG. 8C, a reflection type display device is constituted.

Figure 9A:
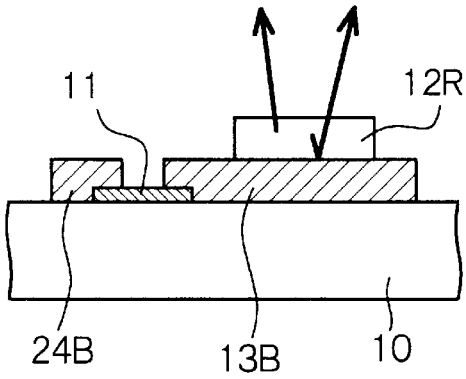
FIGS. 9A, 9B, 9C and 9D are schematic partial cross-sectional views showing other combinations of materials constituting an independent electrode and a substrate.
Figure 9B:
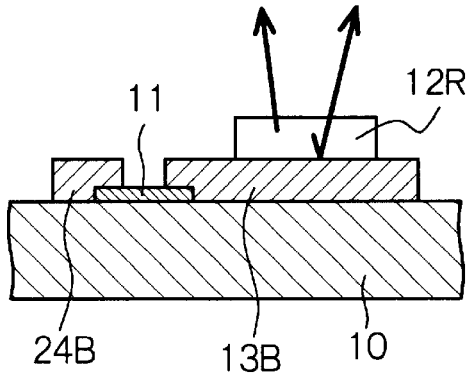
Figure 9C:
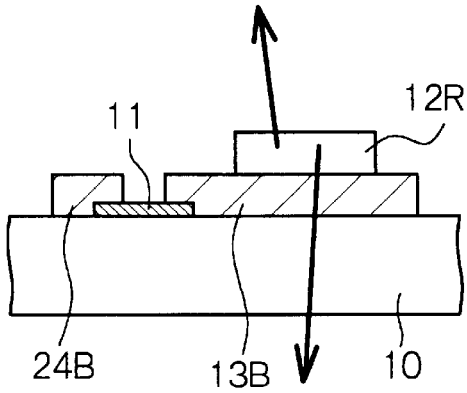
Figure 9D:
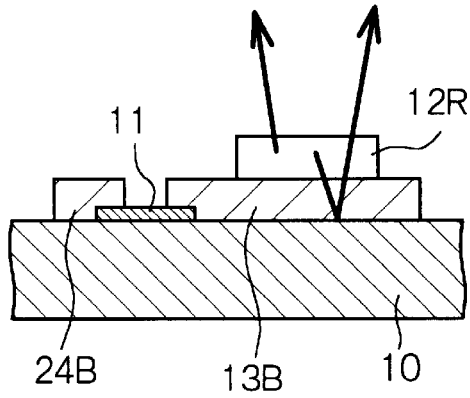

The combinations shown in FIGS. 9A and 9B correspond to the case (2) in which the independent electrode 13B formed between the substrate 10 and the unit fluorescence layer 12R is composed of a non-transparent material such as a conductive reflective layer. In these cases, a reflection type display device is constituted regardless of whether the substrate 10 is transparent as shown in FIG. 9A or is non-transparent as shown in FIG. 9B. FIG. 9C and FIG. 9D show the constitutions in which the independent electrode 13B is composed of a transparent material such as ITO. In these cases, when the substrate 10 is transparent as shown in FIG. 9C, a transmission or reflection type display device can be constituted, and when the substrate 10 is non-transparent as shown in FIG. 9D, a reflection type display device can be constituted.

Figures 10A, 10B, 10C, 10D, 10E:
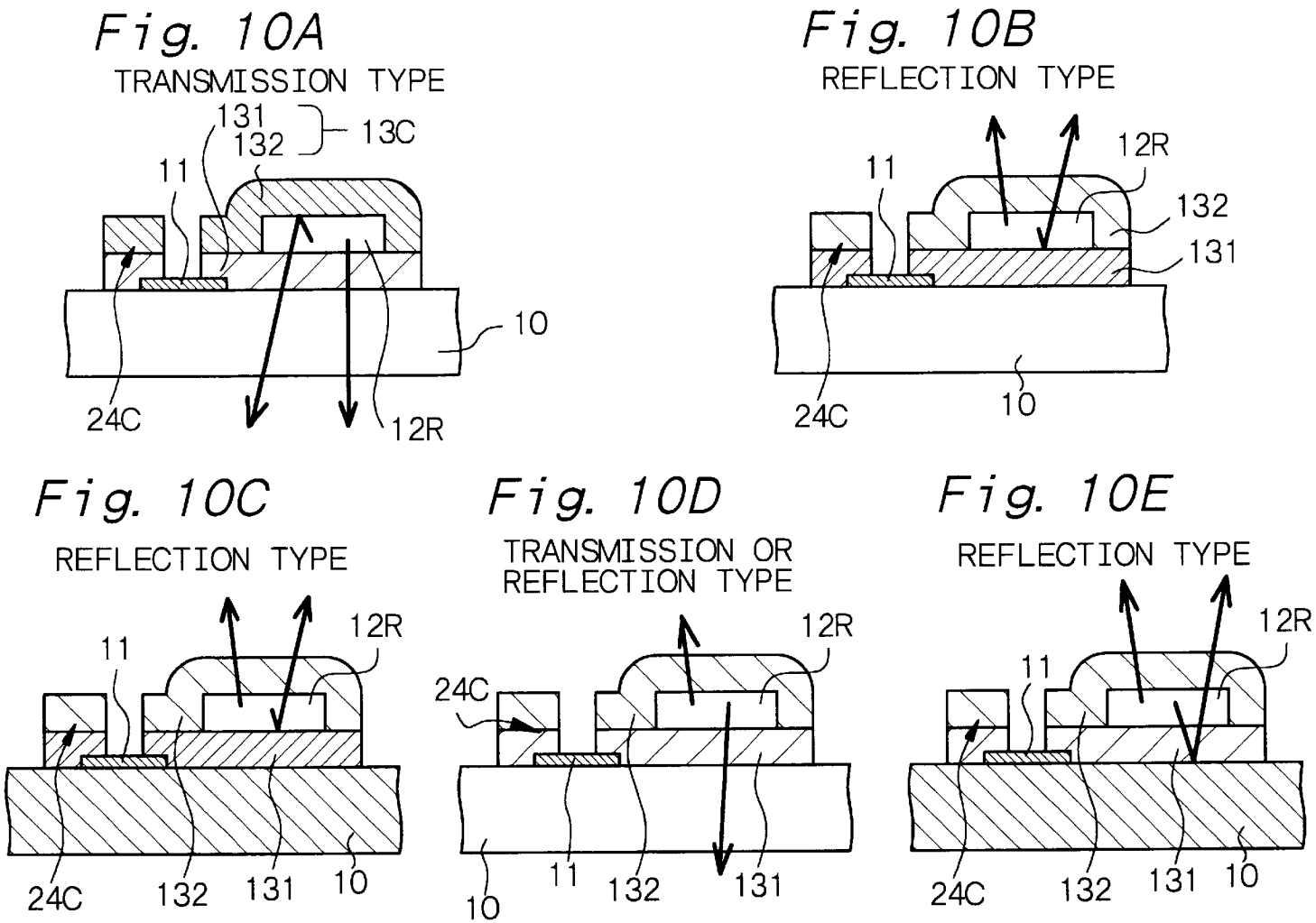
FIGS. 10A, 10B, 10C, 10D and 10E are schematic partial cross-sectional views showing other combinations of materials constituting an independent electrode and a substrate.

The constitution shown in FIG. 10A corresponds to the case (3) in which the upper electrode 132 formed on the unit fluorescence layer 12R is composed of a non-transparent material such as a conductive reflective layer. In this case, the display panel 100 can be obtained only when both the upper electrode 131 and the substrate 10 are transparent, and the display device using the display panel shown in FIG. 10A is inevitably a transmission type. FIGS. 10B and 10C show the constitutions in which the lower electrode 131 formed between the substrate 10 and the unit fluorescence layer 12R is composed of a non-transparent material such as a conductive reflective layer. In these cases, a reflection type display device is constituted regardless of whether the substrate 10 is transparent as shown in FIG. 10B or is non-transparent as shown in FIG. 10C. Further, FIGS. 10D and 10E show the constitutions in which both the lower electrode 131 and the upper electrode 132 are transparent. In these cases, when the substrate 10 is transparent as shown in FIG. 10D, a transmission or reflection type display device can be constituted, and when the substrate 10 is non-transparent as shown in FIG. 10E, a reflection type display device can be constituted. The combinations shown in FIGS. 10A to 10E can similarly apply to the case (i) in the first aspect of the present invention.

The independent electrode 13D comprising the lower electrode 131 and the upper electrode 132 in the case (4) corresponds to a constitution in which each of the lower electrode and the upper electrode in the case (ii) in the first aspect of the present invention is divided into a plurality of independent regions. When the upper electrode 132 of the independent electrode 13D is composed of a non-transparent material such as a conductive reflective layer, the display panel can be constituted only when both the lower electrode 131 and the substrate 10 are transparent, and a transmission type display panel is inevitably constituted. Showing such a constitution is omitted. In contrast, when the upper electrode 132 is composed of a transparent material such as ITO and the lower electrode 131 is non-transparent, a reflection type display device is constituted regardless of whether the substrate 10 is transparent or non-transparent. Further, when both the upper electrode 132 and the lower electrode 131 are transparent and the substrate 10 is transparent, a reflection or transmission type display device is constituted. When both the upper electrode 132 and the lower electrode 131 are transparent and the substrate 10 is non-transparent, a reflection type display device is constituted.

Figure 11A:
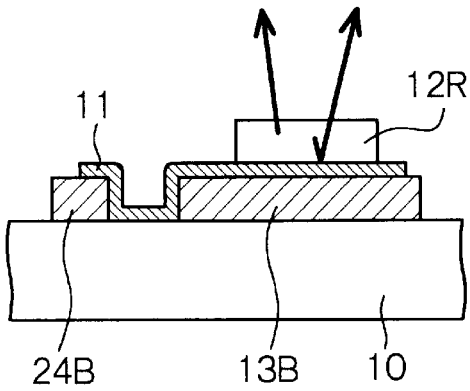
FIGS. 11A, 11B, 11C and 11D are schematic partial cross-sectional views showing other combinations of materials constituting a resistance film, an independent electrode and a substrate.
Figure 11B:
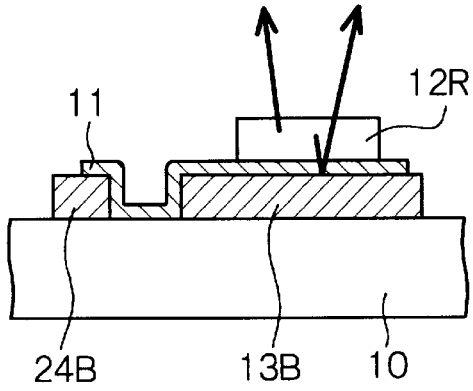
Figure 11C:
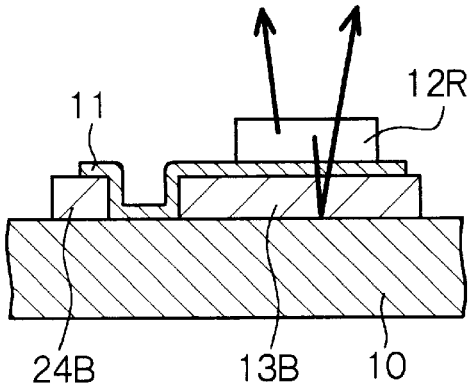
Figure 11D:
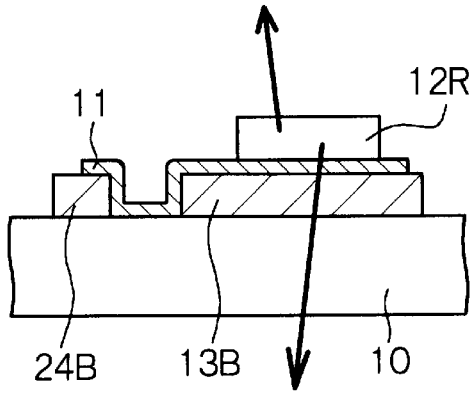

The constitution shown in FIG. 11A corresponds to the case (5) in which the resistance film 11 extending onto the independent electrode 13 is composed of a non-transparent material such as conductive reflective layer. In this case, a reflection type display device is constituted regardless of whether the independent electrode 13B is transparent or non-transparent and whether the substrate 10 is transparent or non-transparent. When the resistance film 11 is composed of a transparent material such as tantalum oxide and the independent electrode 13B is non-transparent as shown in FIG. 11B, a reflection type display device can be constituted regardless of whether the substrate 10 is transparent or non-transparent. When the resistance film 11 is composed of a transparent material such as tantalum oxide, and when the independent electrode 13B is transparent as shown in FIG. 11C and the substrate 10 is non-transparent, a reflection type display device can be constituted. Further, when all of the resistance film 11, the independent electrode 13B and the substrate 10 are transparent, a transmission or reflection type display device as shown in FIG. 11D can be constituted.

Table 1 shows the constitutions of the display devices that can be constituted when the adhesive layer is formed between the resistance film and the independent electrode. Table 2 shows the constitutions of the display devices that can be constituted when the adhesive layer is formed between the resistance film and the unit fluorescence layer. Further, Table 3 shows the constitutions of the display devices that can be constituted when the adhesive layer is formed between the resistance film and the independent electrode and between the resistance film and the unit fluorescence layer. In these Tables, "TP" stands for "transparent", "N-TP" stands for "non-transparent", "TR" stands for "transmission type display device", and "RF" stands for "reflection type display device".

TABLE 1

| | | | | | |
|---|---|---|---|---|---|
| Resistance film | N-TP | TP | TP | TP | TP |
| Adhesive layer | TP or N-TP | N-TP | TP | TP | TP |
| Independent electrode | TP or N-TP | TP or N-TP | N-TP | TP | TP |
| Substrate | TP or N-TP | TP or N-TP | TP or N-TP | N-TP | TP |
| Type of display device | RF | RF | RF | RF | TR or RF |

TABLE 2

| | | | | | |
|---|---|---|---|---|---|
| Adhesive layer | N-TP | TP | TP | TP | TP |
| Resistance film | TP or N-TP | N-TP | TP | TP | TP |
| Independent electrode | TP or N-TP | TP or N-TP | N-TP | TP | TP |
| Substrate | TP or N-TP | TP or N-TP | TP or N-TP | N-TP | TP |
| Type of display device | RF | RF | RF | RF | TR or RF |

TABLE 3

| | | | | | | |
|---|---|---|---|---|---|---|
| Adhesive layer | N-TP | TP | TP | TP | TP | TP |
| Resistance film | TP or N-TP | N-TP | TP | TP | TP | TP |
| Adhesive layer | TP or N-TP | TP or N-TP | N-TP | TP | TP | TP |
| Independent electrode | TP or N-TP | TP or N-TP | TP or N-TP | N-TP | TP | TP |
| Substrate | TP or N-TP | TP or N-TP | TP or N-TP | TP or N-TP | N-TP | TP |
| Type of display device | RF | RF | RF | RF | RF | TR or RF |

EXAMPLE 3

Figure 12A:
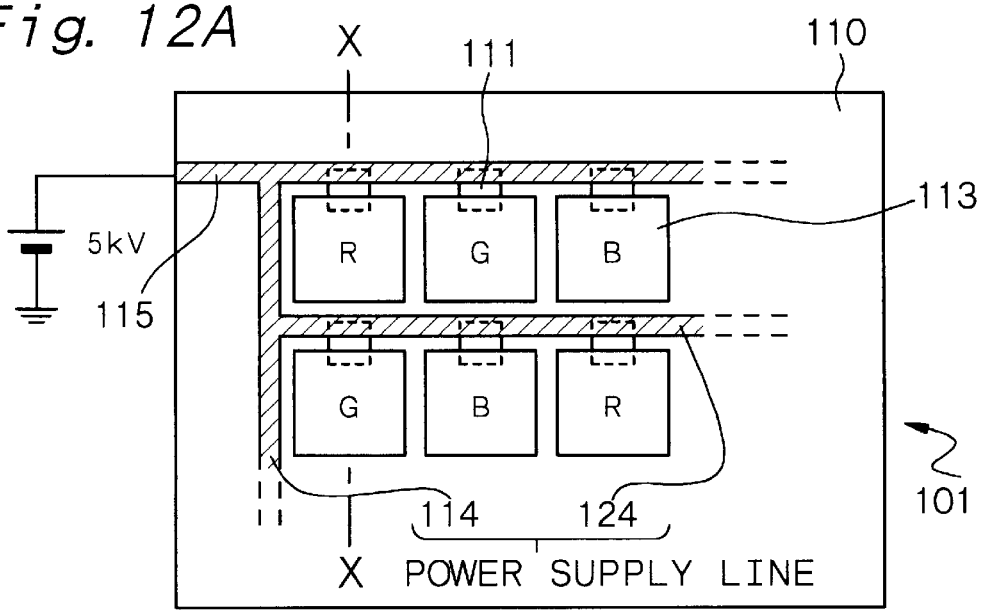
FIG. 12A is a schematic partial plan view and FIGS. 12B, 12C, 12D and 12E are schematic partial cross-sectional views of display panels of Example 3 in which independent electrodes are arranged in the form of a matrix.
Figure 12B:
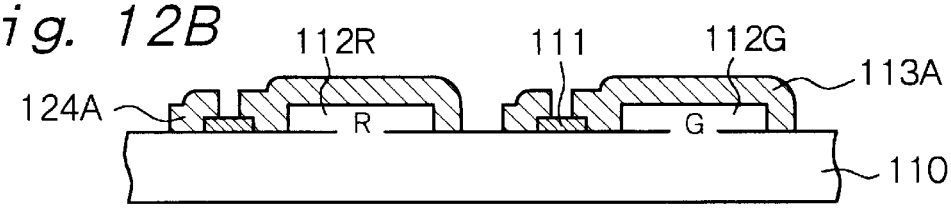
Figure 12C:
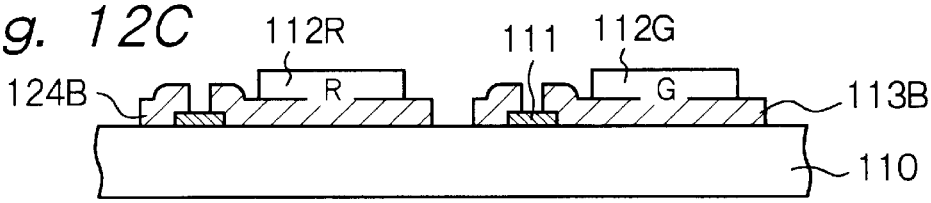
Figure 12D:
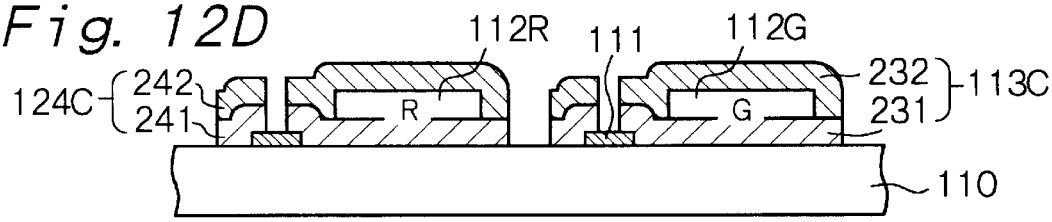

Example 3 is concerned with a display panel as other examples of the display panel of the second-C constitution, in which the independent electrodes are formed such that one independent electrode corresponds to one unit fluorescence layer. FIG. 12A shows a schematic plan view of the display panel of Example 3. As shown in FIG. 12A, the anode electrode of the display panel 101 comprises a plurality of independent electrodes 113 which are formed in the form of a matrix such that the independent electrodes are so formed as to correspond to the unit fluorescence layers 112R, 112G, . . . respectively. A plurality of these independent electrodes 113 as a whole are arranged to nearly cover the effective region. The power supply line is formed on the rectangular substrate 110 composed, for example, of glass, and it comprises one main line 114 extending in the width direction of the rectangular substrate 110 and a plurality of branch lines 124 extending from the main line 114 and in the column direction, i.e., in the direction in parallel with the length direction of the rectangular substrate 110. Each independent electrode 113 is connected to the power supply line through a resistance film 111, and more specifically, the independent electrodes 113 in a column are connected to one common branch line 124, and the independent electrodes 113 in another column are connected to another common branch line 124. The main line 114 is connected to a connecting terminal (not shown) through a lead portion 115, and the connecting terminal is connected to an anode electrode driving circuit. In FIG. 12A, the anode electrode driving circuit is shown by a symbol of a power source (5 kV) for simplification. Each independent electrode 113 has a rectangular form as an example, and the independent electrodes 113 are so formed as to correspond to the unit fluorescence layers 112R (red) and 112G (green), respectively. Although not shown in FIGS. 12A to 12E due to limited space, an independent electrode 113 is formed on a unit fluorescence layer for blue as well.

The display panel 101 shown in FIG. 12A includes some structural cases depending upon constitutions of the independent electrodes 113. FIGS. 12B to 12E show examples thereof. FIGS. 12B to 12E are partial cross-sectional views taken along an X—X line in FIG. 12A. The constitution shown in FIG. 12B corresponds to the case (1) in which the unit fluorescence layers 112R and 112G are formed on the substrate 110 and the independent electrodes 113A are formed on the unit fluorescence layers 112R and 112G, and the above case (1) is the mostly highly consistent with an existing production process when a conductive reflective layer typified by a metal-back layer is used for constituting the independent electrodes 113A. The constitution shown in FIG. 12C corresponds to the case (2) in which the independent electrodes 113B are formed on the substrate 110, and the unit fluorescence layers 112R and 112G are formed on the independent electrodes 113B. The above case (2) is the most highly consistent with an existing production process when a transparent conductive layer typified by an ITO layer is used for constituting the independent electrodes 113B. The constitution shown in FIG. 12D corresponds to the case (3) in which each independent electrode 113C comprises a lower electrode 231 and an upper electrode 232, the lower electrode 231 is formed on the substrate 110, the unit fluorescence layers 112R and 112G are formed on the lower electrode 231, and the upper electrode 232 is formed on the unit fluorescence layers 112R and 112G and the lower electrode 231. The above case (3) corresponds to a constitution in which the anode electrode in the case (i) of the first aspect of the present invention is divided into a plurality of independent regions.

Figure 12E:
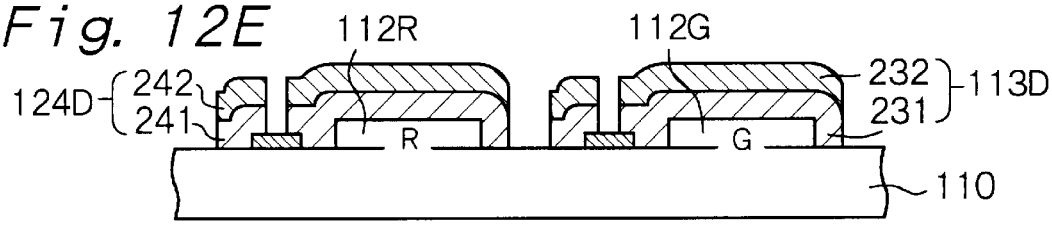

Further, the constitution shown in FIG. 12E corresponds to the case (4) in which each independent electrode 113D comprises a lower electrode 231 and an upper electrode 232, the unit fluorescence layers 112R and 112G are formed on the substrate 110, the lower electrode 231 is formed on the unit fluorescence layers 112R and 112G, and the upper electrode 232 is formed on the lower electrode 231. The above case (4) corresponds to a constitution in which the anode electrode in the case (ii) in the first aspect of the present invention is divided into a plurality of independent regions. In addition to these, the display panel shown in FIG. 12C also includes a constitution in which the resistance film 111 extends onto the independent electrode 113B. The branch lines 124A, 124B, 124C and 124D are composed of the same conductive material layer as that used for forming the independent electrodes 113A, 113B, 113C and 113D. That is, the lower electrode 241 constituting the branch line 124A, 124B, 124C or 124D and the lower electrode 231 constituting the independent electrode 113A, 113B, 113C or 113D are composed of the same conductive material layer, and the upper electrode 242 constituting the branch line 124A, 124B, 124C or 124D and the upper electrode 232 constituting the independent electrode 113A, 113B, 113C or 113D are composed of the same conductive material layer.

The independent electrodes 113A, 113B, 113C and 113D of the display panel 101 of Example 3 can be formed in the same manner as in the formation of the independent electrodes 13A, 13B, 13C and 13D of the display panel 100 of Example 2. The resistance film 111 of the display panel 101 of Example 3 can be formed in the same manner as in the formation of the resistance film 11 of the display panel 100 of Example 2. The main line 114, the branch lines 124A, 124B, 124C and 124D and the lead portion 115 of the display panel 101 of Example 3 can be formed in the same manner as in the formation of the main line 14, the branch lines 24A, 24B, 24C and 24D and the lead portion 15 of the display panel 100 of Example 2. Those constitutions explained with reference to FIGS. 8A to 11D also apply to the display panel 101 of Example 3.

Further, the display panel 101 of Example 3 can be incorporated into a display device like the display panel 100 of Example 2. In the display device using the display panel 101 of Example 3, the electrostatic capacitance is further decreased to a greater extent than in the display device using the display panel 100 of Example 2.

EXAMPLE 4

Figure 13A:
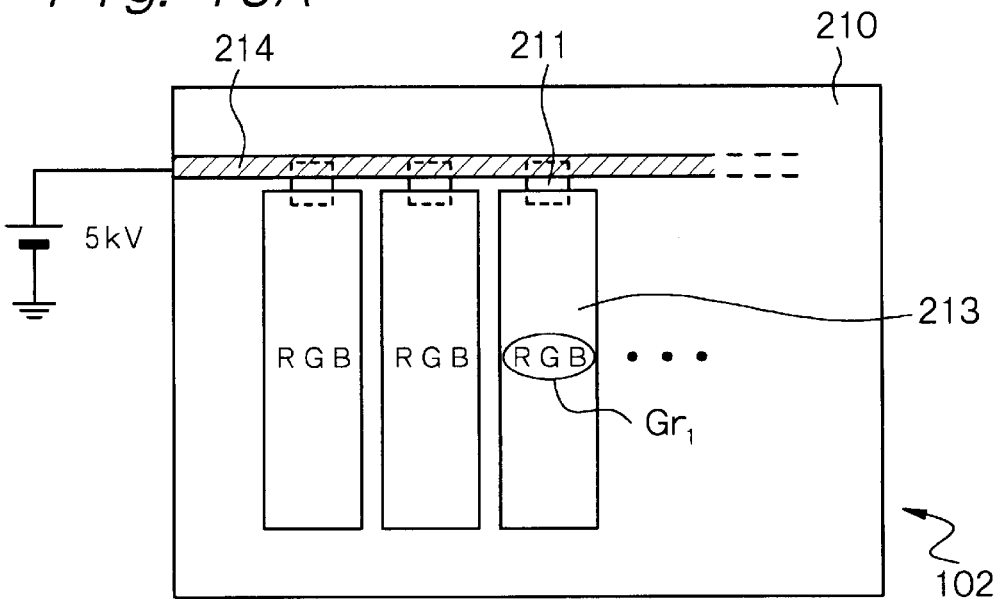
FIGS. 13A and 13B are schematic plan views of display panels of Example 4 in which independent electrodes are arranged in the form of stripes.
Figure 13B:
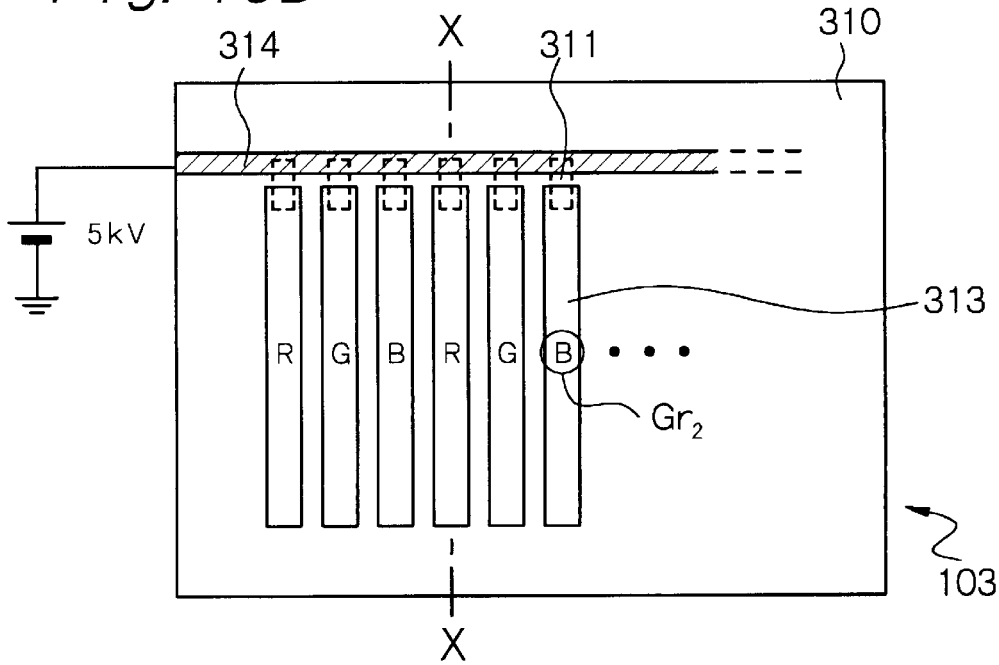
Figure 14A:
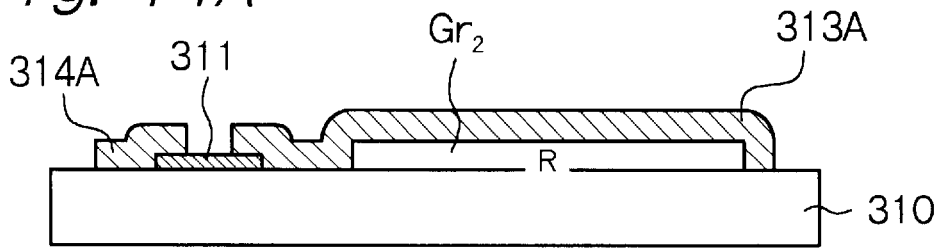
FIGS. 14A, 14B, 14C and 14D are partial cross-sectional views of other display panels taken along X—X line in FIG. 13B.
Figure 14B:
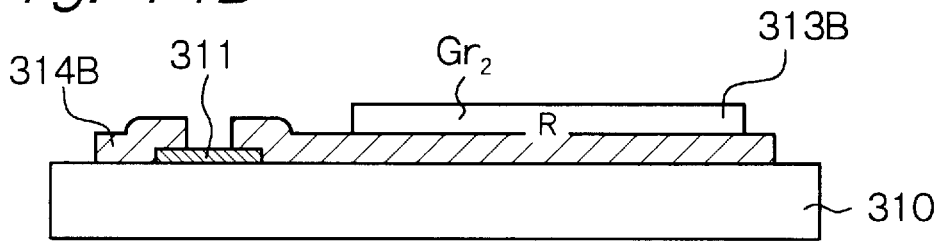
Figure 14C:
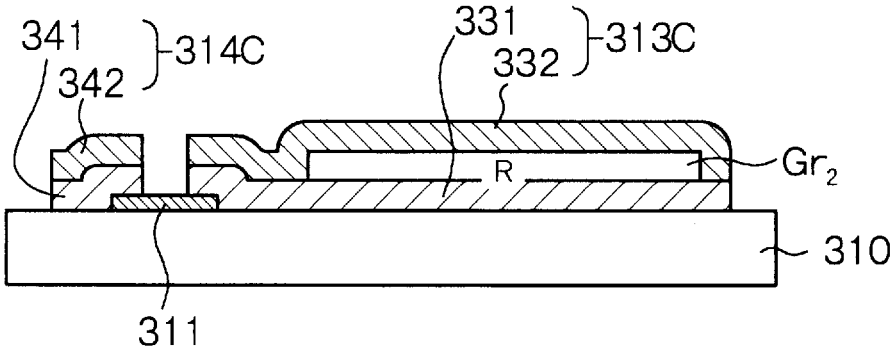
Figure 14D:
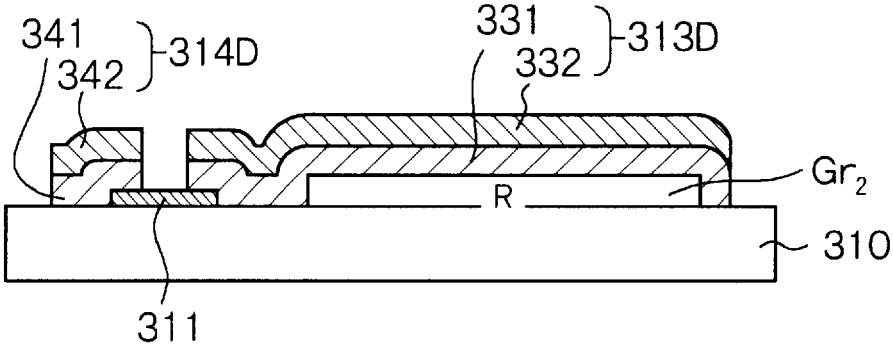

Example 4 is concerned with a display panel of the second-D constitution of the present invention in which independent electrodes are arranged in the form of stripes. FIGS. 13A and 13B show schematic plan views of the display panels of Example 4, and FIGS. 14A to 14D show partial cross-sectional views taken along an X—X line in FIG. 13B. In the display panel 102, as shown in FIG. 13A, the anode electrode comprises a plurality of independent electrodes 213 which are so formed in the form of strips as to correspond to a fluorescence layer group $Gr_1$ consisting of a predetermined number of unit fluorescence layers. The fluorescence layer group $Gr_1$ refers to a set of three fluorescence layer unit groups, each of which consists of a plurality of the unit fluorescence layers emitting one of three primary colors and is arranged in the form of a stripe along the width direction of a substrate 210. That is, in the display panel 102, each independent electrode 213 is so formed as to correspond, for example, to a plurality of pixels. A plurality of these independent electrodes 213 are arranged as a whole to cover the effective region. In FIG. 13A, the stripes extend in the row direction, i.e., in the width direction of the rectangular substrate 210, while they may extend in the length direction. On the substrate 210, one power supply line 214 is formed along a major side of the substrate 210 and in parallel with the major side, and each independent electrode 213 is connected to the power supply line 214 through a resistance film 211. Each independent electrode 213 has the form of a stripe as an example.

In a display panel 103 shown in FIG. 13B, an electrode corresponding to the independent electrode 213 of the display panel 102 is further divided to correspond to each of three primary colors. That is, one independent electrode 313 is so formed as to correspond to one fluorescence layer group $Gr_2$, and another independent electrode is so formed as to correspond to another fluorescence layer group $Gr_2$. Each fluorescence layer group $Gr_2$ refers to a set of a plurality of the unit fluorescence layers emitting one of three primary colors and is arranged in the form of a stripe. On a substrate 310, one power supply line 314 is formed along a major side of the substrate 310 and in parallel with the major side, and each independent electrode 313 is connected to the power supply line 314 through a resistance film 311. The power supply line 214 or 314 is connected to a connecting terminal (not shown) provided in a peripheral portion of the display panel 102 or 103, and the connecting terminal is connected to an anode electrode driving circuit. In FIGS. 13A and 13B, the anode electrode driving circuit is shown by a symbol of a power source (5 kV) for simplification.

The display panel 102 shown in FIG. 13A and the display panel 103 shown in FIG. 13B include some structural cases depending upon constitutions of the independent electrodes 213 and 313. FIGS. 14A to 14D show some of the structural cases of the display panel 103 as examples. The display panel 102 also has such similar structural cases. FIGS. 14A to 14D show partial cross-sectional views taken along an X—X line in FIG. 13B. In FIGS. 14A to 14D, a fluorescence layer group $Gr_2$ of red (R) color is shown as a typical example. The constitution shown in FIG. 14A corresponds to the case (1) in which the fluorescence layer group $Gr_2$ is formed on a substrate 310 and an independent electrode 313A is formed on the fluorescence layer group $Gr_2$. The above case (1) is the most highly consistent with an existing production process when only a conductive reflective layer typified by a metal-back layer is used for constituting the independent electrode 313A. The constitution shown in FIG. 14B corresponds to the case (2) in which an independent electrode 313B is formed on the substrate 310 and the fluorescence layer group $Gr_2$ is formed on the independent electrode 313B. The above case (2) is the most highly consistent with an existing production process when a transparent conductive layer typified by an ITO layer is used for constituting the independent electrode 313B. The constitution shown in FIG. 14C corresponds to the case (3) in which an independent electrode 313C comprises a lower electrode 331 and an upper electrode 332, the lower electrode 331 is formed on the substrate 310, the fluorescence layer group $Gr_2$ is formed on the lower electrode 331, and the upper electrode 332 is formed on the fluorescence layer group $Gr_2$ and the lower electrode 331. The above case (3) corresponds to a constitution in which the anode electrode in the case (i) in the first aspect of the present invention is divided into a plurality of independent regions. The constitution shown in FIG. 14D corresponds to the case (4) in which an independent electrode 313 comprises a lower electrode 331 and an upper electrode 332, the fluorescence layer group $Gr_2$ is formed on the substrate 310, the lower electrode 331 is formed on the fluorescence layer group $Gr_2$, and the upper electrode 332 is formed on the lower electrode 331. The above case (4) corresponds to a constitution in which the anode electrode in the case (ii) in the first aspect of the present invention is divided into a plurality of independent regions. Further, the display panel shown in FIG. 14B includes the case (5) in which the resistance film 311 extends onto the independent electrode 313B. The power supply lines 314A, 314B, 314C or 314D and the independent electrodes 313A, 313B, 313C or 313D are composed of the same conductive material layer. That is, the lower electrode 341 constituting the power supply line 314A, 314B, 314C or 314D and the lower electrode 331 constituting the independent electrode 313A, 313B, 313C or 313D are composed of the same conductive material layer, and the upper electrode 342 constituting the power supply line 314A, 314B, 314C or 314D and the upper electrode 331 constituting the independent electrode 313A, 313B, 313C or 313D are composed of the same conductive material layer.

The independent electrode 213 of the display panel 102 and the independent electrodes 313, 313A, 313B, 313C and 313D of the display panel 103 in Example 4 can be formed in the same manner as in the formation of the independent electrodes 13A, 13B, 13C and 13D of the display panel 100 of Example 2. The resistance film 211 of the display panel 102 and the resistance film 311 of the display panel 103 in Example 4 can be formed in the same manner as in the formation of the resistance film 11 of the display panel 100 of Example 2. The power supply line 214 of the display panel 102 and the power supply line 314 of the display panel 103 in Example 4 can be formed in the same manner as in the formation of the power supply line of the display panel 100 of Example 2. Those constitutions explained with reference to FIGS. 8A to FIG. 11D also apply to the display panels 102 and 103 in Example 4.

Each of the display panels 102 and 103 of Example 4 can be incorporated into a display device like the display panel 100 of Example 2. In a display device having the above fluorescence layer group shaped in the form of stripes, generally, so-called line sequential display is performed. For example, in the display panel 102 shown in FIG. 13A, only a current of approximately several $\mu$A flows per independent electrode 213, so that a voltage drop caused by the above resistance film 211 is approximately several volts to several tens volts. Such a voltage drop is at a level that is negligible as compared with an anode voltage which is generally the order of several kilovolts. In the display devices using the display panels 102 and 103 of Example 4, therefore, no substantial decrease in brightness is caused, and a high voltage can be stably applied to the anode electrode (i.e., independent electrodes 213 and 313).

EXAMPLE 5

Figure 15A:
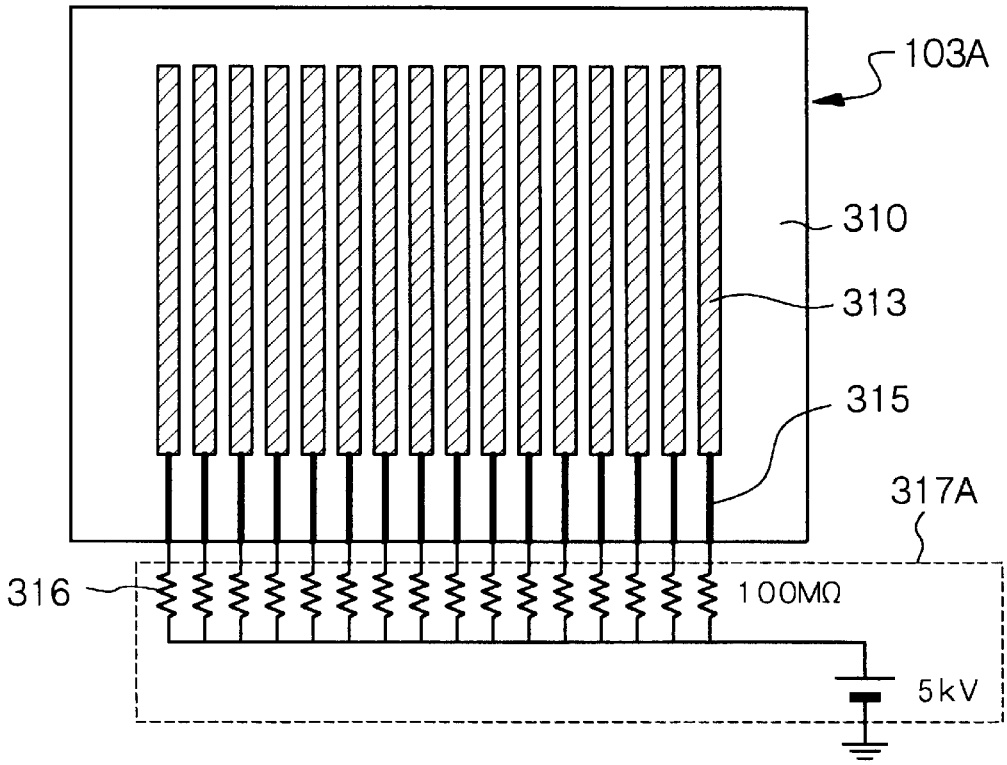
FIG. 15A is a schematic plan view of a display panel of Example 5 in which unit power supply lines are provided and independent electrodes are arranged nearly in parallel with cathode electrodes.
Figure 16A:
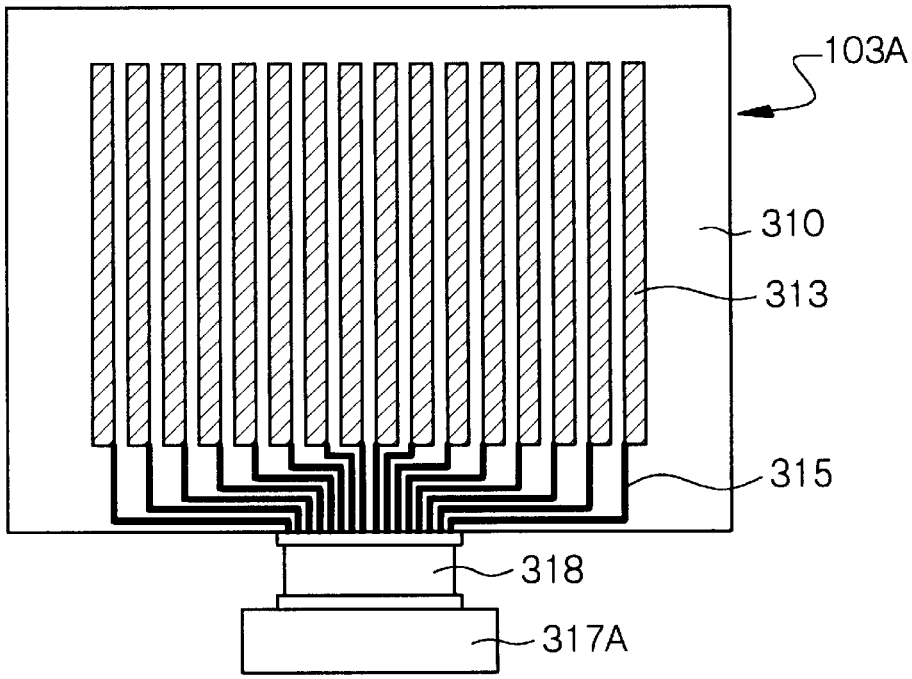
FIGS. 16A and 16B are schematic plan views of other configuration examples of the display panel of Example 5.

Example 5 is concerned with display panels of the second-A constitution and the second-B constitution of the present invention. FIG. 15A shows a schematic plan view of a display panel 103A of the second-A constitution. In the display panel 103A, independent electrodes 313 are so arranged in the form of stripes as to correspond to fluorescence layer groups each of which consists of a plurality of unit fluorescence layers. A power supply line comprises a plurality of unit power supply lines 315, and each unit power supply lines 315 is connected to each independent electrode 313. That is, each of the unit power supply lines 315 is so provided as to correspond to each of the independent electrodes 313. In FIG. 15A, the independent electrodes 313 are indicated by hatching for clarification. In FIG. 15A, the number of the independent electrodes 313 is 16, which is just for showing as an example. On a peripheral portion of the display panel 103A, a terminal of each unit power supply line 315 is provided with a connecting terminal (not shown), and each unit power supply line is connected to an anode electrode driving circuit 317A through the connecting terminal. In a constitution in which only the anode electrode is divided as described above, the effect of decreasing the electrostatic capacitance can be produced. In Example 5, further, resistance members corresponding are provided to the unit power supply lines 315 for temporarily discontinuing the supply of energy to the independent electrodes 313 when a discharge takes place and for stabilizing a brightness. In the display panel shown in FIG. 15A, resistance members 316 having a resistance, for example, of 100 MΩ are inserted somewhere in lines connected to each unit power supply line 315 in the anode electrode driving circuit 317A, and each line is connected to a common power source line. A positive voltage, for example, of a 5 kilovolts is applied to each independent electrode 313 from a built-in power source of the anode electrode driving circuit through the above power source line. FIG. 15A shows an equivalent circuit, and in a practical constitution, the unit power supply lines 315 are extended to an idle region of the display panel 103A, collected on one place in a peripheral portion of the display panel 103A and connected to the anode electrode driving circuit 317A provided with the resistance members through a connecting means 318 as shown in FIG. 16A. The independent electrode 313 may has any constitution of the cases (1) to (4). The connecting means 318 includes a flexible printed wiring board and a bonding wire. When the connecting means 318 is a flexible printed wiring board, a resistance member is inserted somewhere in each of the lines connecting the independent electrodes 313 and the corresponding connecting terminals of the anode electrode driving circuit 317A. When the connecting member 318 is a bonding wire, there can be used a bonding wire having a desired resistance value.

Figure 15B:
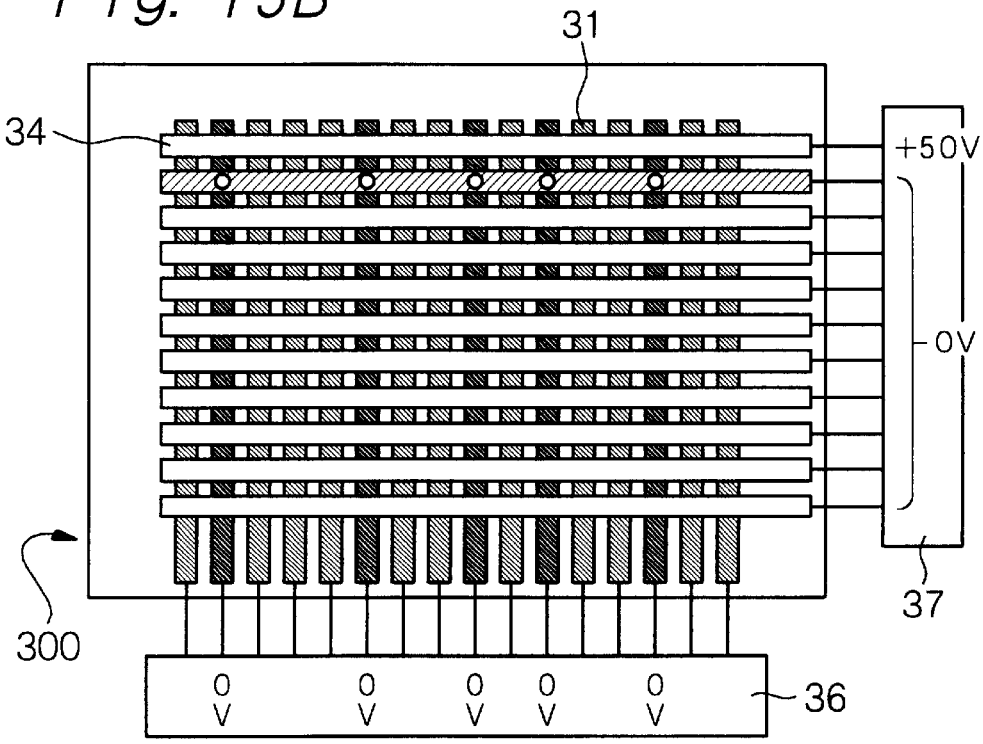
FIG. 15B is a schematic plan view of a rear panel which is arranged to be opposed to the display panel.

FIG. 15B shows a schematic plan view of a rear panel 300 having a plurality of electron emitting members, which rear panel 300 is arranged to be opposed to the above display panel 103A through a vacuum space. The electron emitting members are disposed in regions (i.e., overlap regions) where projection images of a first electrode group (specifically, a plurality of gate electrodes 34) which extend in one direction and to which scanning signals are inputted and a second electrode group (specifically, a plurality of cathode electrodes 31) which extend in the other direction and to which video signals are inputted overlap each other. The scanning signals are inputted from a gate electrode driving circuit 37, and the video signals are inputted from a cathode electrode driving circuit 36. The independent electrodes 313 shown in FIG. 15A extend in the direction nearly in parallel with the second electrode group, i.e., a plurality of the cathode electrodes 31. In this Example, the number of the independent electrodes 313 and the number of the cathode electrodes 31 are the same, while there may be employed a constitution in which a plurality of the cathode electrodes 31 correspond to one independent electrode 313. In the above constitution, electrons are substantially simultaneously emitted from desired overlap regions among the overlap regions positioned on the electrodes constituting the first electrode group.

In FIG. 15B, for clarification, the cathode electrodes 31 in a non-selected state (to which a voltage of +50 volts is applied from the cathode electrode driving circuit 36) are indicated by less dense hatchings, and the cathode electrodes 31 in a selected state (to which a voltage of 0 volt is applied from the cathode electrode driving circuit 36) are indicated by dense hatchings. Video signals applied to the cathode electrodes 31 in a selected state can have a value (intermediate tones) of from 0 volt or more to leas than +50 volts depending upon tones, while they are assumed to have 0 volt at which a maximum brightness (full tone) can be obtained, for simplification. Concerning the gate electrodes 34, a non-selected state (a voltage of 0 volt is applied from the gate electrode driving circuit 37) is indicated by a blank, and a selected state (a voltage of +50 volts is applied from the gate electrode driving circuit 37) is indicated by hatchings. A region (overlap region) where projection images of the cathode electrode 31 and the gate electrode 34 overlap each other corresponds to one pixel in a monochromatic display device or one sub-pixel in a full color display, and generally, a plurality of the field emission devices are arranged per overlap region. The overlap regions of the selected cathode electrodes 31 and the selected gate electrodes 34 are the selected pixels (or selected sub-pixels), and are indicated by blank circles. The gate electrodes 34 are referred to as m-th column from top to bottom, and the cathode electrodes 31 are referred to as n-th row from left to right.

For example, it is assumed as follows. When the gate electrode 34 on the 2nd column is selected, five cathode electrodes 31 such as the cathode electrodes on the 2nd, 6th, 9th, 11th and 14th rows are selected as shown in FIG. 15B, and when a current of 1 μA flows from each of the five independent electrodes 313 on the 2nd, 6th, 9th, 11th and 14th rows which face the cathode electrode 31, during a full tone. In this case, a voltage drop comes to be 1 μA×100 MΩ=0.1 kilovolt. That is, between a cathode electrode 31 on any row and any independent electrode 313, an acceleration voltage comes to be 5−0.1=4.9 kilovolts. A current of smaller than 1 μA flows during an intermediate tone, so that a voltage drop comes to be smaller than 0.1 kilovolt. In any case, since the anode electrode is divided into a plurality of the independent electrodes 313, a voltage drop takes place only in a constant range (0.1 kilovolt in the above example) without regard to the number of the cathode electrodes 31 selected, whereby the brightness on a display screen is stabilized. When scanning signals are inputted to the cathode electrodes 31 and video signals are inputted to the gate electrodes 34 unlike the above-explained example, it is sufficient to arrange the independent electrodes 313 nearly in parallel with the gate electrodes 34.

Figure 16B:
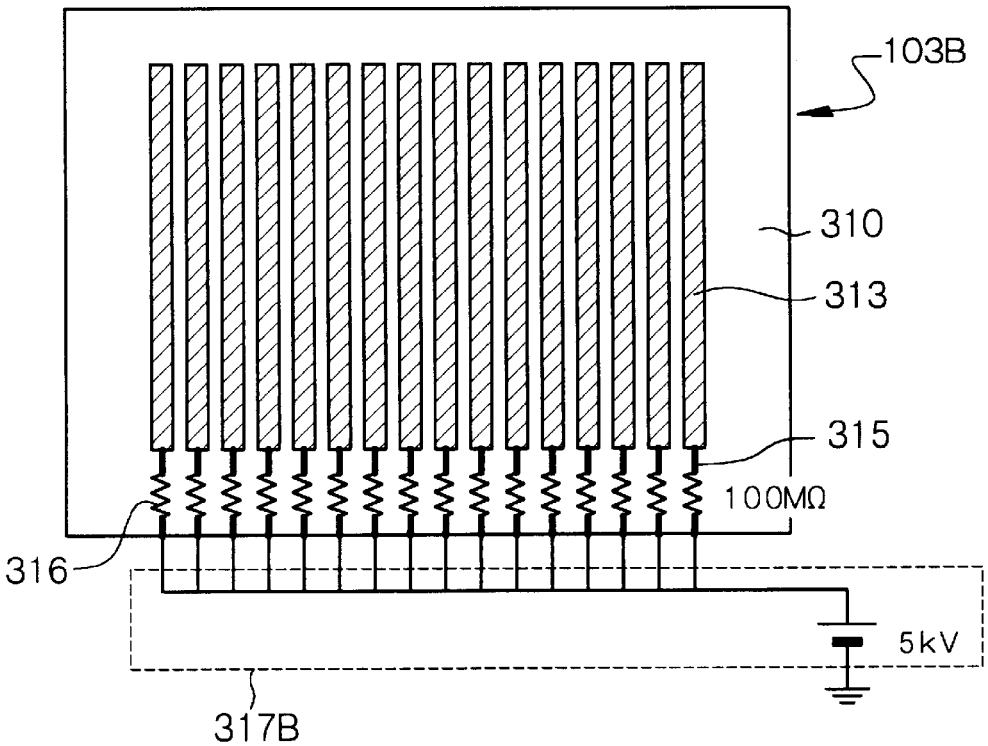

FIG. 16B shows a schematic plan view of a display panel 103B of the second-B constitution. In the display panel 103B, the constitution of independent electrodes 313 is the same as that in the display panel 103A, while resistance members 316 are inserted somewhere in the unit power supply lines 315. The resistance member 316 can be selected from chip resistors or resistance films. FIG. 16B also shows an equivalent circuit, and in a practical constitution, there may be employed a constitution as shown in FIG. 16A in which the unit power supply lines 315 are collected on one place in a peripheral portion of the display panel 103B and connected to an anode electrode driving circuit 317B having no resistance member with a similar connecting means 318.

EXAMPLE 6

Figure 17A:
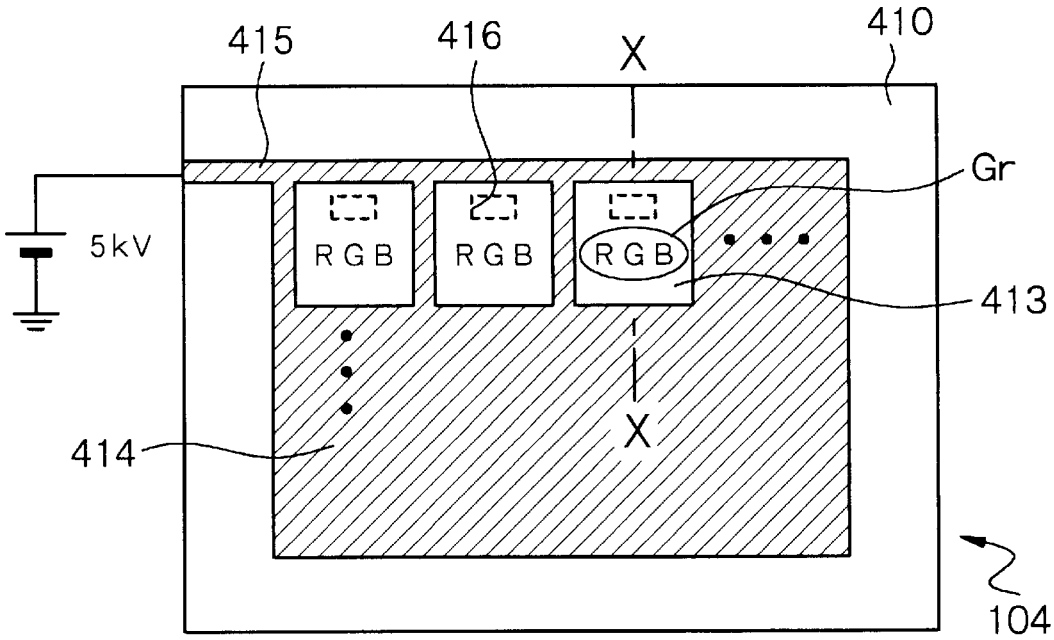
FIGS. 17A and 17B are schematic plan views of a display panel of Example 6 in which independent electrodes are arranged in the form of a matrix.
Figure 17B:
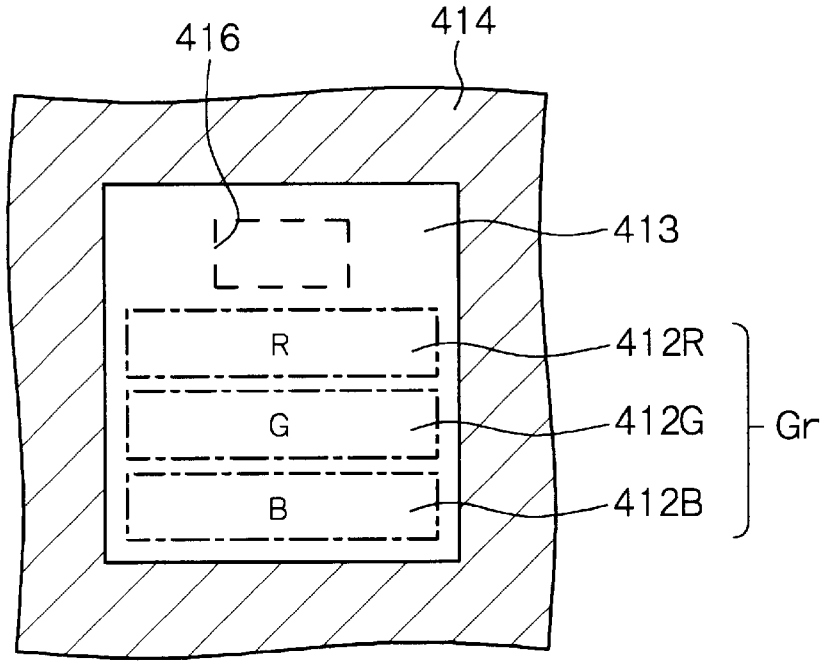
Figure 18A:
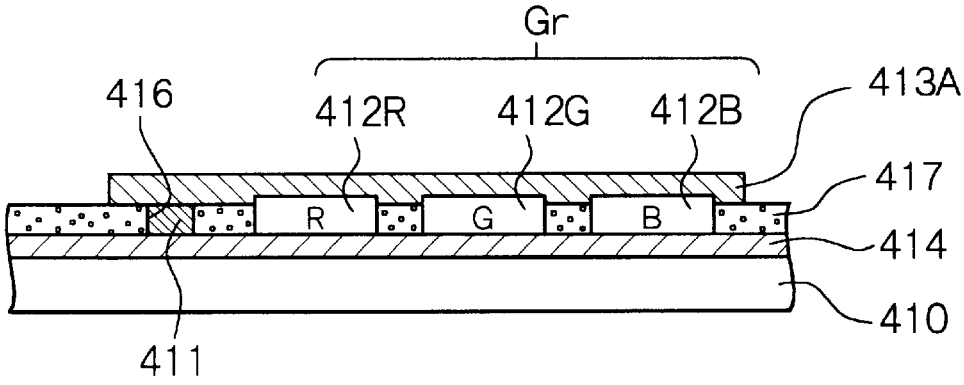
FIGS. 18A and 18B are partial cross-sectional views of display panels taken along an X—X line in FIG. 17A.
Figure 18B:
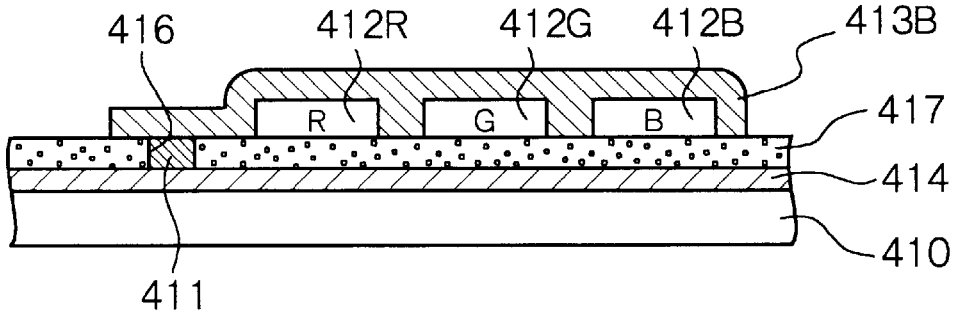

Example 6 is concerned with a display panel of the third-A constitution. FIG. 17A shows a schematic plan view of the display panel of Example 6, and FIG. 17B shows an enlarged view of vicinities of an independent electrode. FIGS. 18A and 18B show schematic partial cross-sectional views taken along an X—X line in FIG. 17A and show two structural cases based on constitutions of the independent electrode.

In the display panel 104 of Example 6, as shown in these Figures, the anode electrode comprises a plurality of independent electrodes 413 so as to correspond to a plurality of unit fluorescence layers 412R, 412G and 412B. The display panel 104 has a power supply layer 414 formed on a substrate 410, an insulating layer 417 formed on the power supply layer 414, the unit fluorescence layers 412R, 412G and 412B formed on the power supply layer 414 or the insulating layer 417, the independent electrodes 413 formed on the unit fluorescence layers 412R, 412G and 412B so as to reach the insulating layer 417, holes 416 formed in the insulating layer 417 and resistance layers 411 filled in the holes 416. The independent electrode 413 is connected to the power supply layer 414 with the resistance layer 411. The power supply layer 414 is formed on the substrate 410 to nearly cover the effective region, and the independent electrodes 413 as a whole are also arranged to nearly cover the effective region. The power supply layer 414 may be formed as desired. Each independent electrode 413 is so formed as to correspond to a fluorescence layer group Gr consisting of the unit fluorescence layers 412R, 412G and 412B as shown in an enlarged view of FIG. 17B. The layout of the unit fluorescence layers 412R, 412G and 412B in FIG. 17B is given for consistency with partial cross-sectional views of FIGS. 18A and 18B for convenience, and the layout thereof shall not be limited to the layout shown in FIG. 17B.

The display panel 104 shown in FIG. 17A includes two kinds of constitutions shown in FIGS. 18A and 18B depending upon constitutions of the independent electrodes 413. FIG. 18A shows a constitution in which the unit fluorescence layers 412R, 412G and 412B are formed on the power supply layer 414, and FIG. 18B shows a constitution in which the unit fluorescence layers 412R, 412G and 412G are formed on the insulating layer 417. The constitution shown in FIG. 18A is feasible when the unit fluorescence layers 412R, 412G and 412G have a sufficiently high resistivity, and it is advantageous for flattening the display panel and is consequently advantageous for decreasing the thickness of a display device using the display panel. The constitution shown in FIG. 18B is suitable when the unit fluorescence layers 412R, 412G and 412G have an insufficient resistivity. Like the case (ii) according to the first aspect of the present invention, the independent electrodes 413A and 413B may have a two-layered structure comprising a lower electrode and an upper electrode formed thereon.

In the constitution shown in FIG. 18A, a type difference of a display device finally constituted, whether it is a transmission type or a reflection type, is caused depending upon the combinations of materials used for constituting the substrate 410, the power supply layer 414 and the independent electrode 413A.

The above difference is substantially the same as that in examples explained with reference to FIGS. 10A to 10E. The constitution shown in FIG. 18B includes a diversity of the combinations since the insulating layer 417 is added to these layers. However, a reflection type display device can be constituted when one non-transparent layer is present nearer to the substrate 410 side than the unit fluorescence layers 412R, 412G and 412B, a transmission type display device can be constituted when the independent electrode 413B is non-transparent, and any one of a transmission type display device and a reflection type display device can be constituted when all the layers and the substrate are transparent. The above basic thought is applicable to any case. For example, the power supply layer 414 can be constituted of a transparent conductive layer typified by an ITO layer and the independent electrodes 413A and 413B can be constituted of a conductive reflective layer typified by a metal-back layer. In this case, a transmission type display device is constituted.

In the display panel 104 of Example 6, it is no longer necessary to form the power supply line on a surface flush with the surface of the independent electrodes 413A and 413B, so that the configuration of the unit fluorescence layers can be increased in density. In a display device into which the above display device 104 is incorporated, screen display having a higher fineness can be achieved.

EXAMPLE 7

Figure 19A:
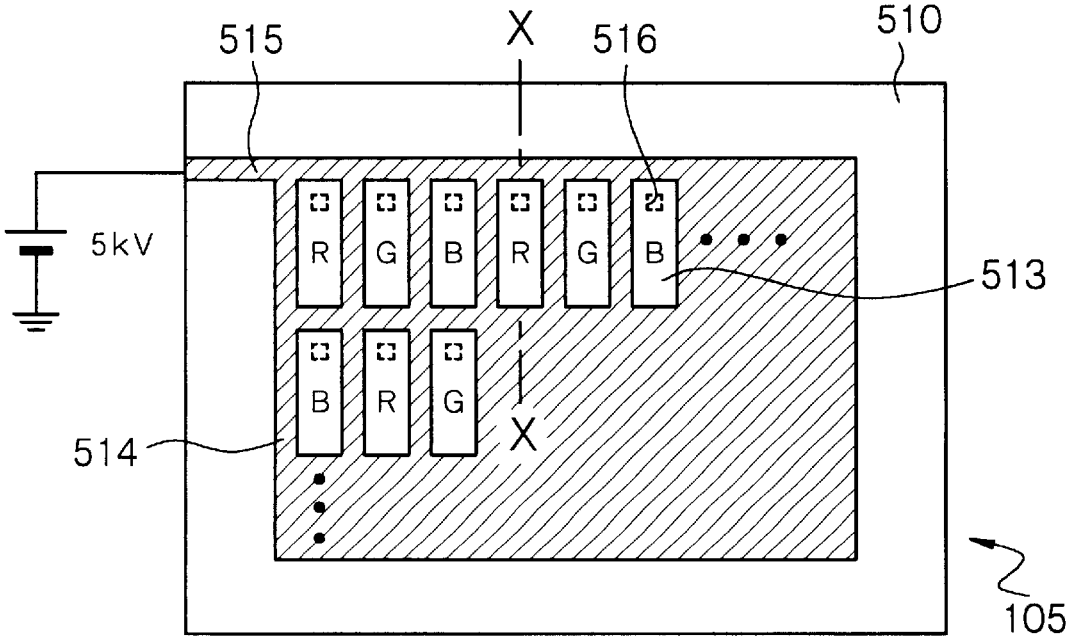
FIGS. 19A and 19B are schematic plan views of a display panel of Example 7 in which independent electrodes are arranged in the form of a matrix.
Figure 19B:
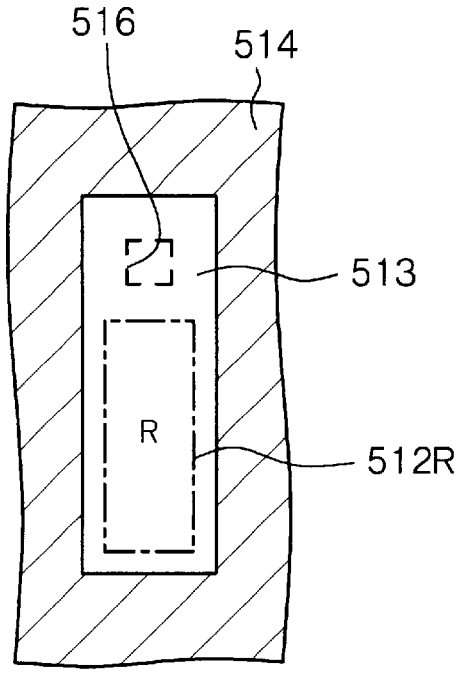
Figure 20A:
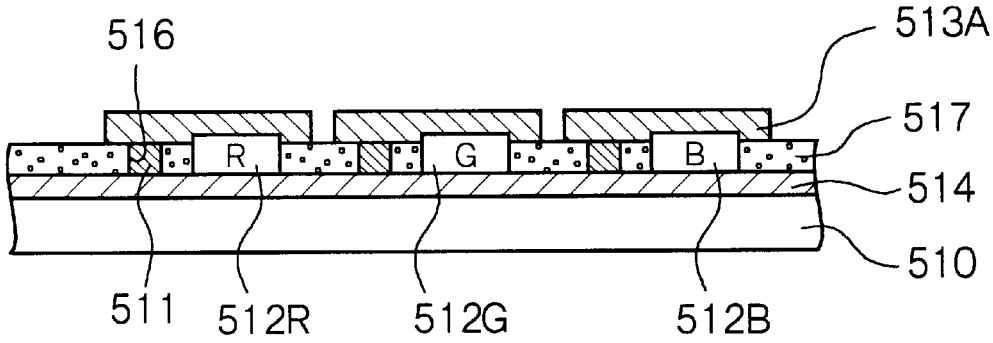
FIGS. 20A and 20B are partial cross-sectional views of display panels taken along an X—X line in FIG. 19A.
Figure 20B:
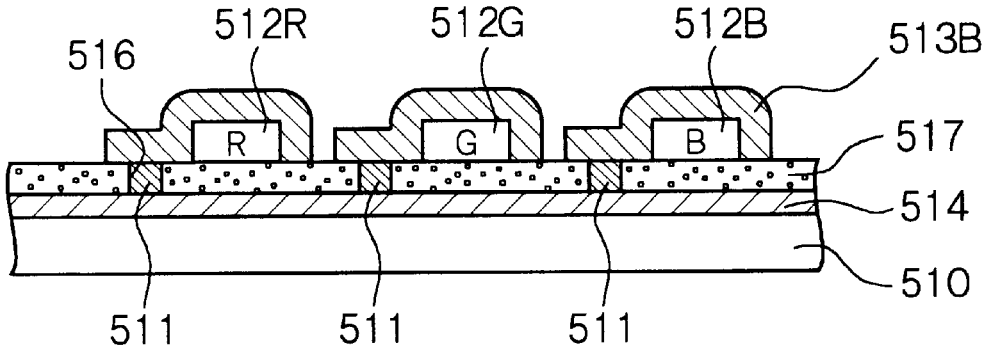

Example 7 is concerned with another example of the display panel of the third-A constitution, i.e., a display panel in which one independent electrode is so formed as to correspond to one unit fluorescence layer. FIG. 19A shows a schematic plan view of the display panel of Example 7, and FIG. 19B shows an enlarged view of vicinities of an independent electrode. FIGS. 20A and 20B show schematic partial cross-sectional views taken along an X—X line in FIG. 19A and show two kinds of structural cases based on the constitution of the independent electrode.

In the display panel 105 of Example 7, the anode electrode comprises a plurality of independent electrodes 513, each of which is so formed as to correspond to each of the unit fluorescence layers 512R, 512G and 512B. The display panel 105 has a power supply layer 514 formed on a substrate 510, an insulating layer 517 formed on the power supply layer 514, the unit fluorescence layers 512R, 512G and 512B formed on the power supply layer 514 or the insulating layer 517, the independent electrodes 513 formed on the unit fluorescence layers 512R, 512G and 512B to reach the surface of the insulating layer 517, holes 516 formed in the insulating layer 517 and resistance layers 511 filled in the holes 516. The independent electrode 513 is connected to the power supply layer 514 with the resistance layer 511. The power supply layer 514 is so formed on the substrate 510 as to nearly cover an effective region, and the independent electrodes 513 are arranged as a whole to nearly cover the effective region. The power supply layer 514 may be formed to have the same pattern as that of the independent electrodes 513.

FIGS. 20A and 20B show two kinds of constitution of the display panel 105 shown in FIG. 19A. FIG. 20A shows a constitution in which the unit fluorescence layers 512R, 512G and 512B are formed on the power supply layer 514, and FIG. 20B shows a constitution in which the unit fluorescence layers 512R, 512G and 512B are formed on the insulating layer 517. In FIGS. 19A, 19B, 20A and 20B, the same members as those in FIGS. 17A to 18B are shown by the same reference numerals except that the first digit 4 is replaced with 5, and explanations of the same members are omitted.

Like the display panel 100 of Example 2, the display panel 105 of Example 7 can be incorporated into a display device. When one independent electrodes 513 is so formed as to correspond to one unit fluorescence layer 512R, 512G or 512B, as shown in the display panel 105 of Example 7, a great number of the independent electrodes 513 are constituted. Since, however, the power supply layer 514 and the independent electrodes 513 are three-dimensionally arranged through the insulating layer 517, excellent fineness on a screen can be achieved.

EXAMPLE 8

Figure 21A:
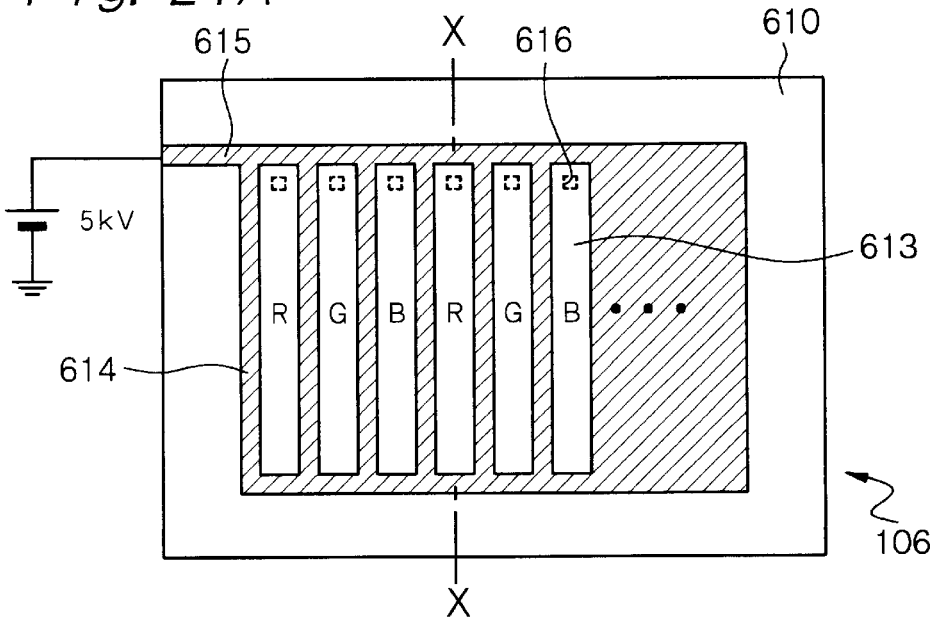
FIG. 21A is a schematic partial plan view and FIGS. 21B and 21C are schematic partial cross-sectional views of display panels of Example 8 in which independent electrodes are arranged in the form of stripes.
Figure 21B:
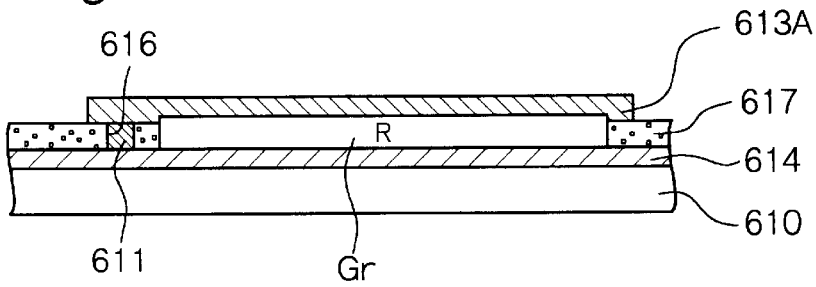
Figure 21C:
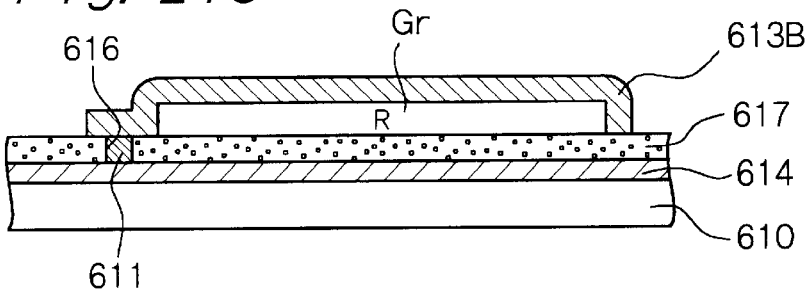

Example 8 is concerned with a display panel 106 of the third-B constitution of the present invention in which independent electrodes are formed in the form of stripes. FIG. 21A shows a schematic plan view of the display panel 106, and FIGS. 21B and 21C show schematic partial cross-sectional views taken along an X—X line in FIG. 21A. In FIGS. 21A and 21B, the same members as those in FIGS. 19A to 20B are shown by the same reference numerals except that the first digit 5 is replaced with 6. The display panel 106 of Example 8 is a display panel structured by replacing the unit fluorescence layers 512R of the display panel 105 of Example 7 with a fluorescence layer group Gr extending in the form of stripes, and detailed explanations thereof are omitted. Like the display panel 100 of Example 2, the display panel 106 of Example 8 can be incorporated into a display device.

The present invention has been explained with reference to Example, while the present invention shall not be limited thereto. Particulars of structures of the display panels and particulars of structures of the display devices to which the display panels are applied have been described as examples, and they can be altered, selected and combined as required. Further, the materials and methods used for constituting the display panels can be also altered, selected and combined as required.

The field emission device is not specially limited to the Spindt type field emission device, and it can be any one of an edge type field emission device, a flat type field emission device, a low-profile type field emission device and a crown type field emission device.

Figure 22A:
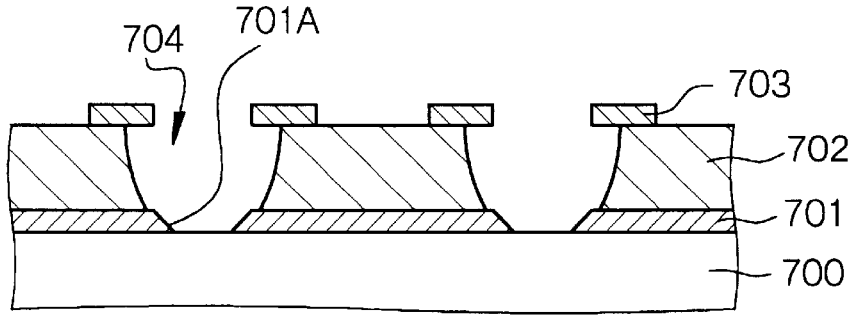
FIGS. 22A, 22B and 23C are schematic partial cross-sectional views of edge type cold cathode field emission devices.
Figure 22B:
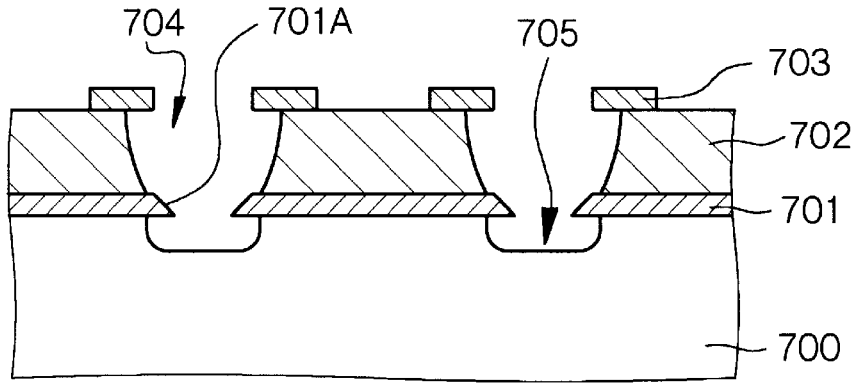
Figure 22C:
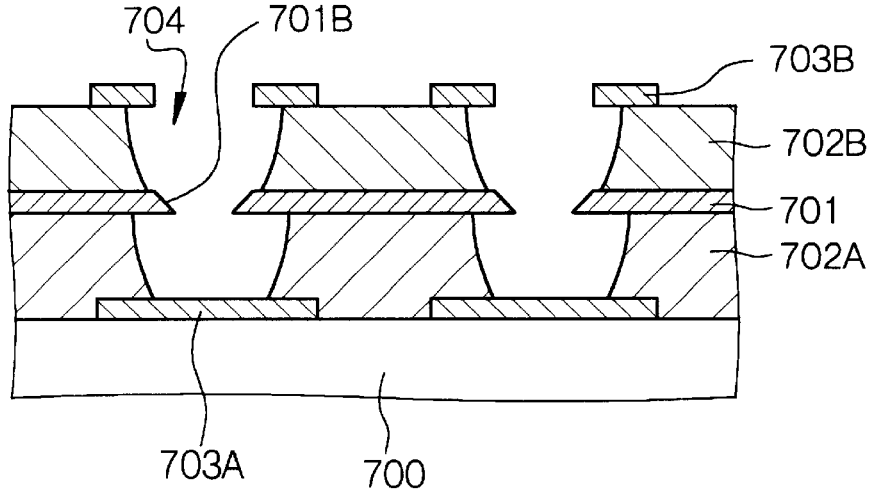

As FIG. 22A shows a schematic partial cross-sectional view, an edge type field emission device comprises an electron emitting layer 701 formed on a supporting member (supporting substrate) 700, an insulating interlayer 702 formed on the supporting member 700 and the electron emitting layer 701, and a gate electrode 703 formed on the insulating interlayer 702. An opening portion 704 is formed in the gate electrode 703 and the insulating interlayer 702, and has a bottom portion where an edge portion 701A of the electron emitting layer 701 is exposed. Electrons are emitted from the edge portion 701A of the electron emitting layer 701 by properly applying voltages to the electron emitting layer 701 and the gate electrode 703. As is shown in FIG. 22B, a recess 705 may be formed in the supporting member 700 under the electron emitting layer 701 in the opening portion 704. Further, as FIG. 22C shows a schematic partial cross-sectional view, an edge type field emission device comprises a first gate electrode 703A formed on a supporting member (supporting substrate) 700, a first insulating interlayer 702A formed on the supporting member 700 and the first gate electrode 703A, an electron emitting layer 701 formed on the first insulating interlayer 702A, a second insulating interlayer 702B formed on the electron emitting layer 701 and the first insulating interlayer 702A, and a second gate electrode 703B formed on the second insulating interlayer 702B. An opening portion 704 is formed in the second gate electrode 703B, the second insulating interlayer 702B, the electron emitting layer 701 and the first insulating interlayer 702A, and has a bottom portion where the first gate electrode 703A is exposed. An edge portion 701B is exposed on a side wall of the opening portion 704. Electrons are emitted from the edge portion 701B of the electron emitting layer 701 by properly applying voltages to the electron emitting layer 701 and the first and second gate electrode 703A and 703B.

Figure 23A:
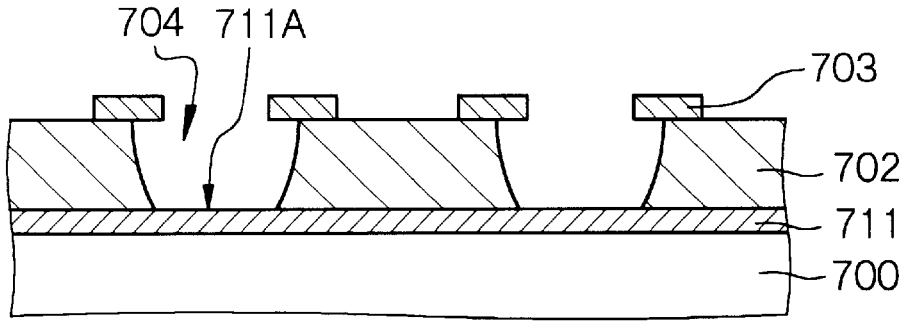
FIG. 23A is a schematic partial cross-sectional view of a flat type cold cathode field emission device.

As FIG. 23A shows a schematic partial cross-sectional view, a flat type field emission device comprises a cathode electrode 711 formed on a supporting member (supporting substrate) 700, an insulating interlayer 702 formed on the supporting member 700 and the cathode electrode 711, and a gate electrode 703 formed on the insulating interlayer 702. An opening portion 704 is formed in the gate electrode 703 and the insulating interlayer 702, and has a bottom portion where the cathode electrode 711 is exposed. Electrons are emitted from an exposed portion 711A of the cathode electrode 711 by properly applying voltages to the cathode electrode 711 and the gate electrode 703.

Figure 23B:
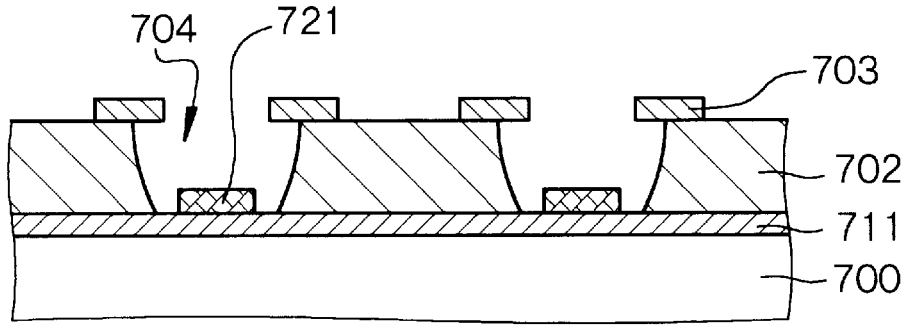
FIG. 23B is a schematic partial cross-sectional view of a low-profile type cold cathode field emission device.
Figure 23C:
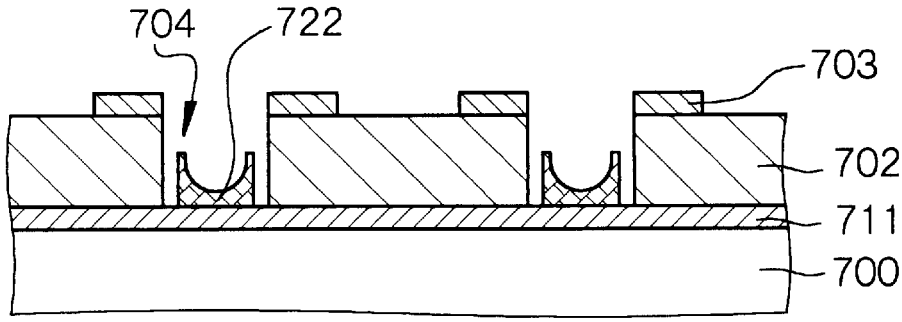
Figure 24:
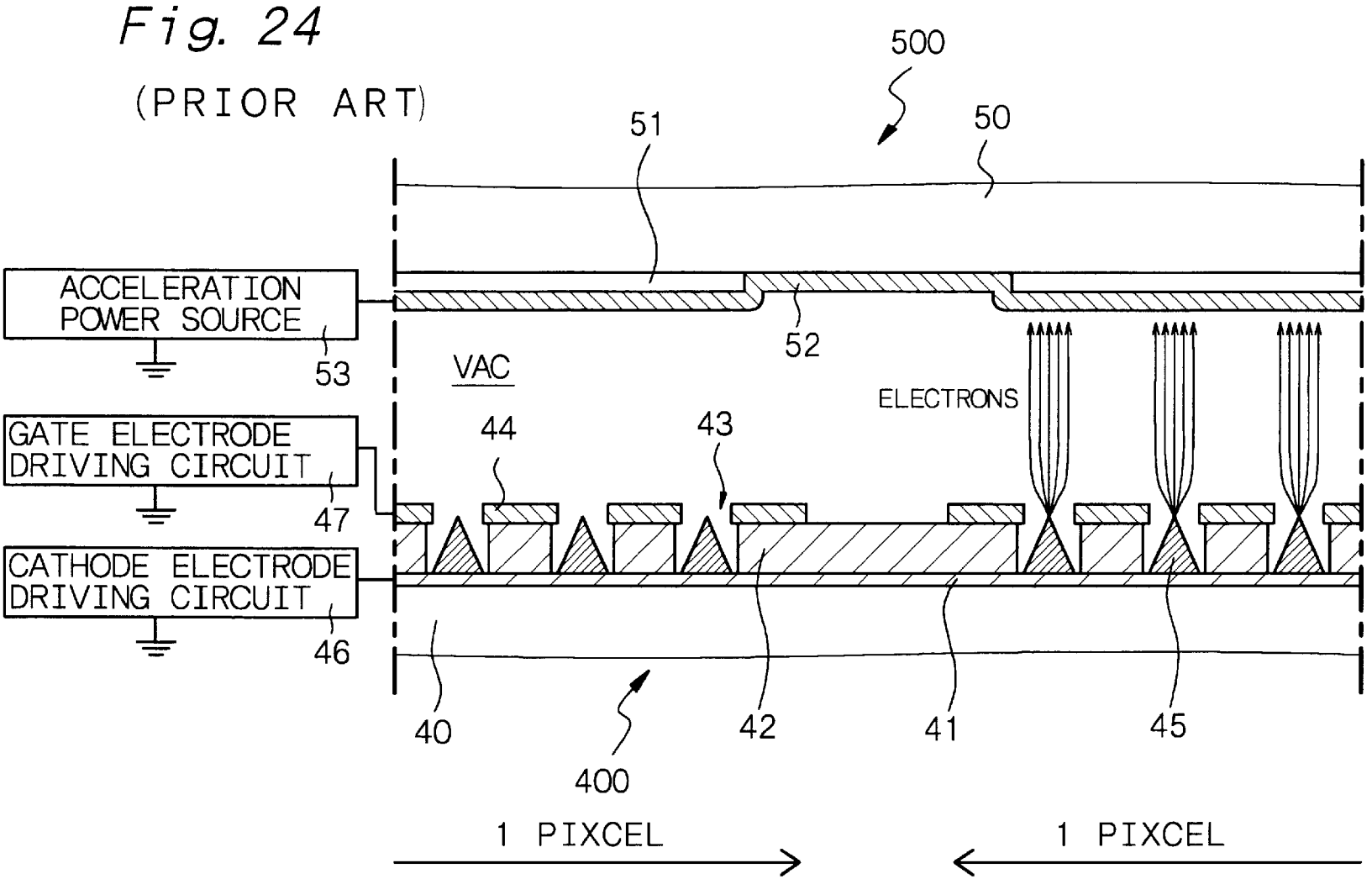
Fig. 24 (PRIOR ART)
FIG. 24 is a conceptual view of a conventional display device having field emission devices.
Figure 25A:
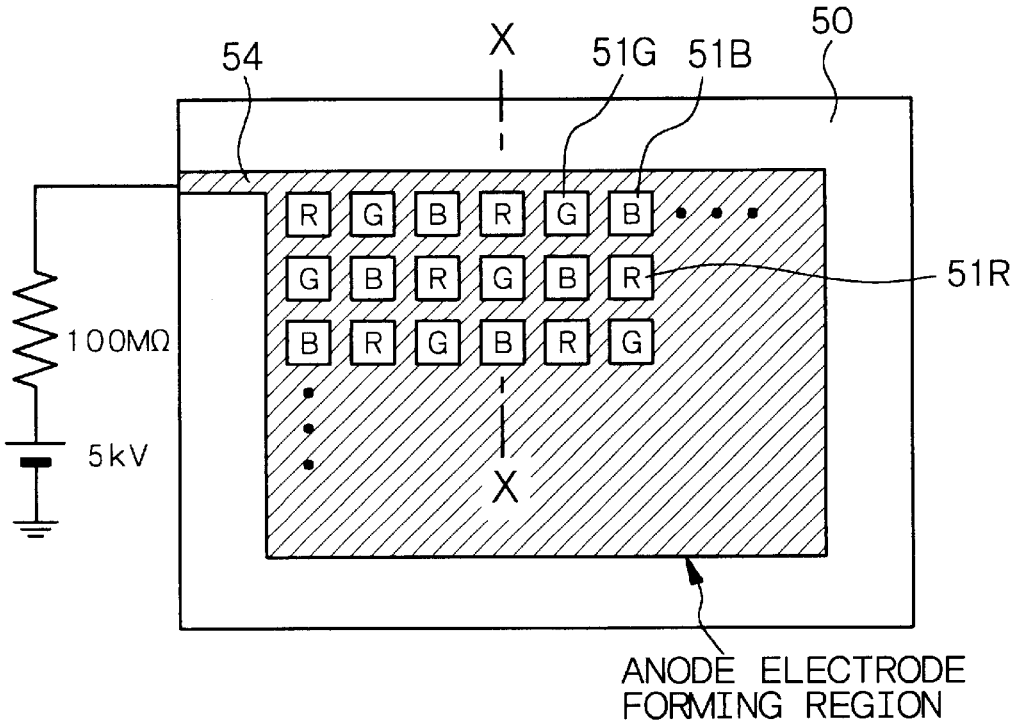
(PRIOR ART) Fig. 25A
FIG. 25A is a schematic partial plan view and FIGS. 25B and 25C are schematic partial cross-sectional views of conventional display panels in which fluorescence layers are arranged in the form of a matrix.
Figure 25B:
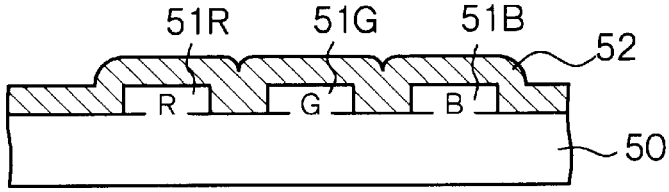
Figure 25C:
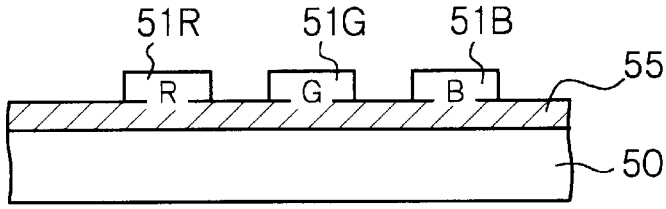
Figure 26A:
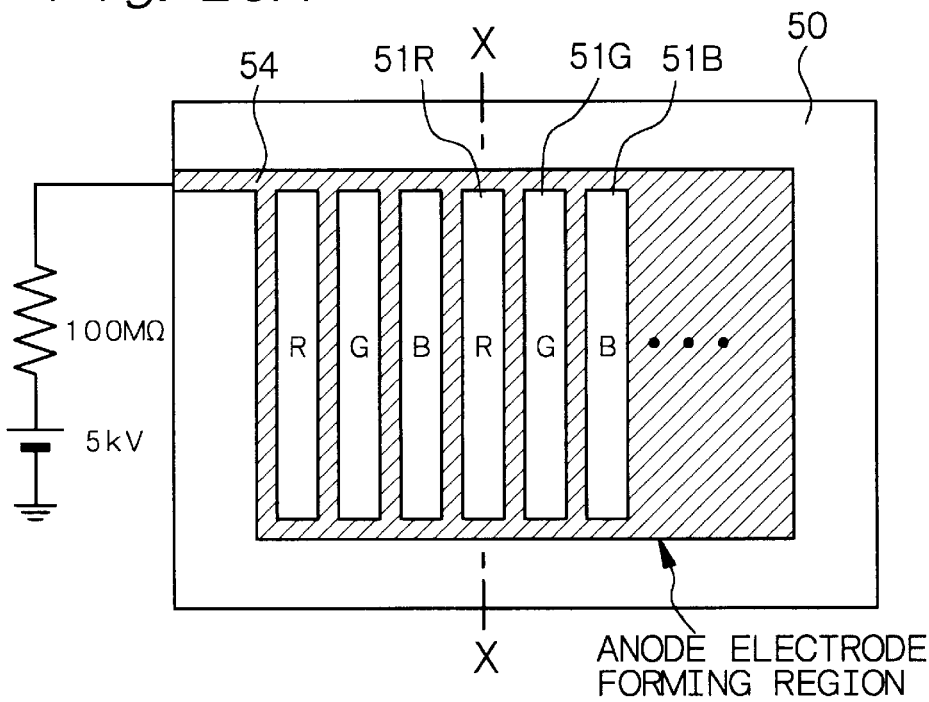
(PRIOR ART) Fig. 26A
FIG. 26A is a schematic partial plan view and FIGS. 26B and 26C are schematic partial cross-sectional views of conventional display panels in which fluorescence layers are arranged in the form of stripes.
Figure 26B:
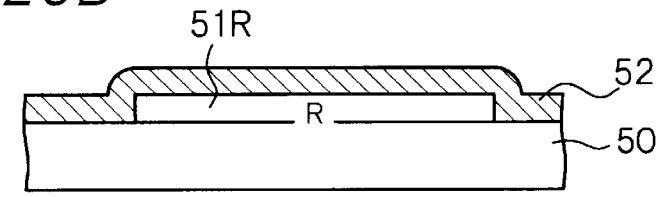
Figure 26C:
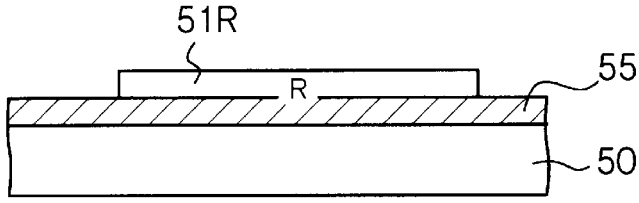
Figure 27A:
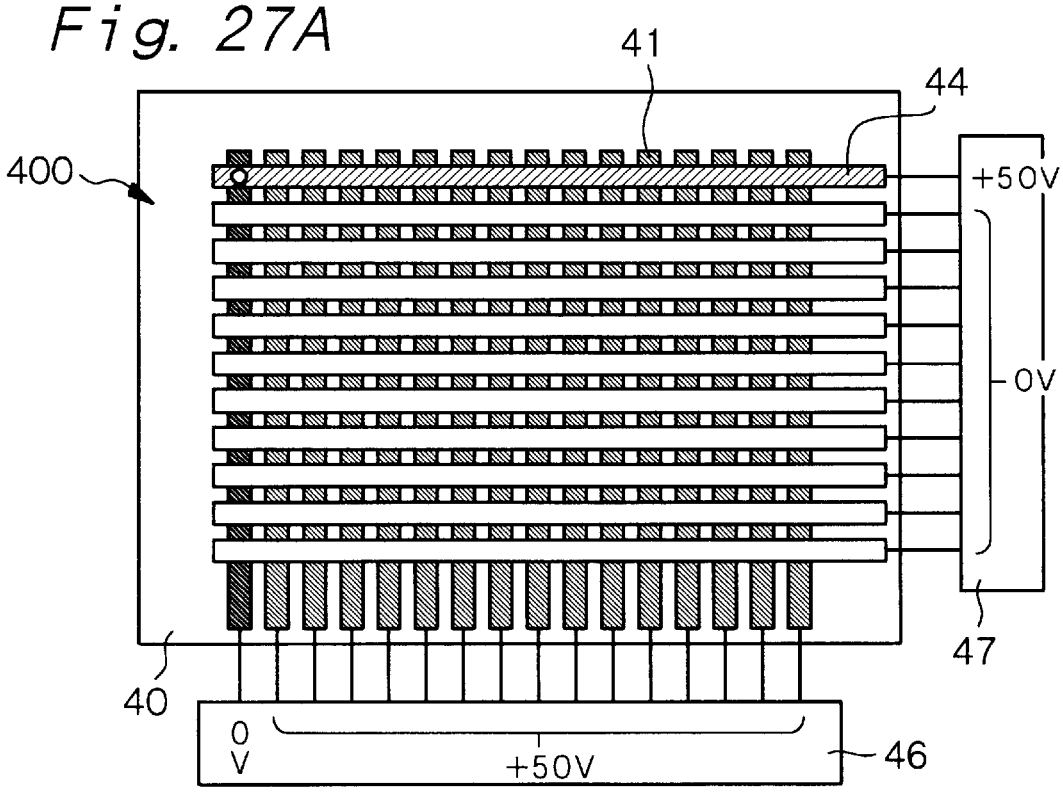
(PRIOR ART) Fig. 27A
FIGS. 27A and 27B are schematic plan views of a rear panel for explaining a variance of acceleration voltage caused by a difference in the selected number of cathode electrodes.
Figure 27B:
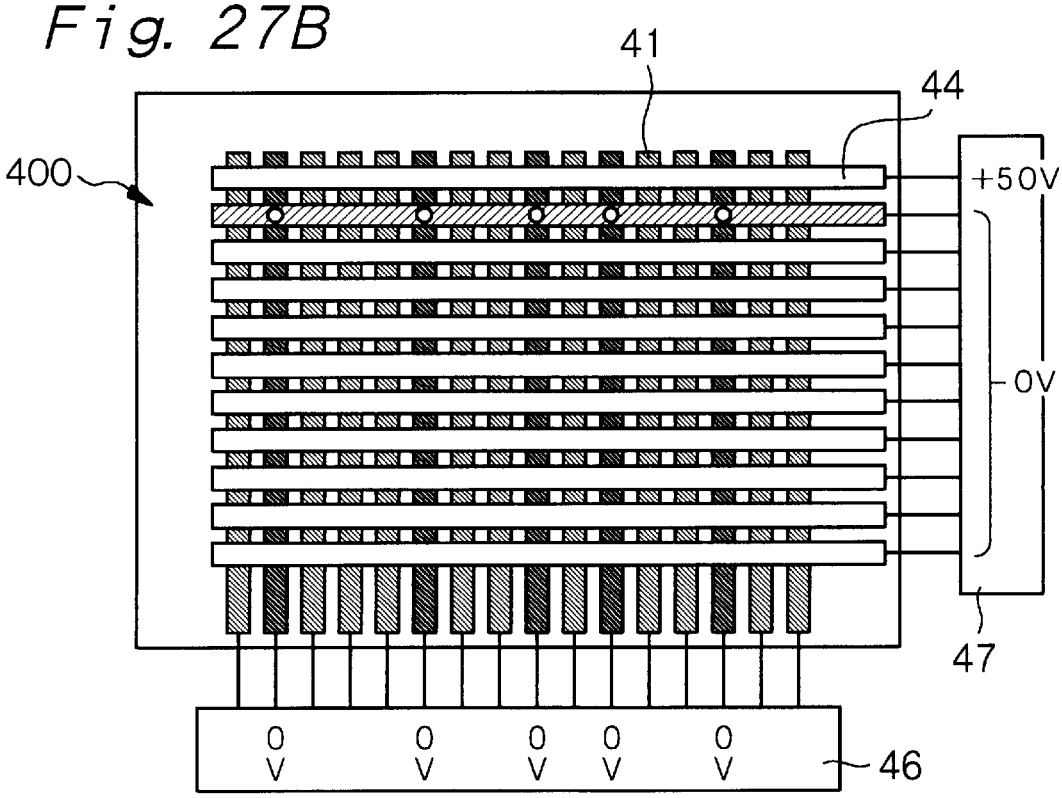

As FIG. 23B shows a schematic partial cross-sectional view, a low-profile type field emission device comprises a cathode electrode 711 formed on a supporting member (supporting substrate) 700, an insulating interlayer 702 formed on the supporting member 700 and the cathode electrode 711, and a gate electrode 703 formed on the insulating interlayer 702. An opening portion 704 is formed in the gate electrode 703 and the insulating interlayer 702, and has a bottom portion where an electron emitting portion 721 which is formed on the cathode electrode 711 and has a flat form is exposed. Electrons are emitted from the electron emitting portion 721 by properly applying voltages to the cathode electrode 711 and the gate electrode 703. The electron emitting portion 721 is composed of a material which has an electron emission efficiency higher than a refractory metal has. As is shown in FIG. 23C, a crown type field emission device can be obtained by replacing the electron emitting portion 721 with a electron emitting portion 722 having a crown form.

As is clear from the above explanations, in the display panel and the display device according to the first aspect of the present invention, the anode electrode has a two-layered structure comprising the lower electrode and the upper electrode, and a charge is removed through both the lower electrode and the upper electrode, so that the deterioration of the fluorescence layer is prevented and that a long lifetime of display panel is achieved. As a consequence, a long lifetime of the display device can be achieved. Therefore, the first object of the present invention is achieved.

In the display panel and the display device according to the second aspect of the present invention, instead of preventing a discharge phenomenon which is to trigger a spark discharge, the electrostatic capacitance, for example, between the anode electrode and the cathode electrode is decreased to such an extent that there is supplied no energy sufficient for promoting a discharge of a small scale, if any, to grow to a spark discharge, whereby the spark discharge can be effectively prevented. In a so-called low voltage type display device in which the gap between the display panel and the rear panel is relatively small, therefore, a high voltage can be applied to the anode electrode as well, and there can be achieved the second object of the present invention that there is provided a display device which can overcome conventional disadvantages with retaining the advantages of the low voltage type display device such as a simple panel structure and a low cost and which permits stabilized high-brightness displaying with a low power consumption. In some layout modes of the independent electrodes, a voltage drop can be always controlled to be in a constant range regardless of the number of selected electrodes to which video signals are inputted on the rear panel side, whereby not only the second object of the present invention is achieved but also there is achieved the third object of the present invention to obtain a display device in which the brightness on a display screen is stabilized.

In the display panel and the display device according to the third aspect of the present invention, the screen fineness can be further improved while achieving effects similar to the effects of the display panel and the display device according to the first and second aspects of the present invention, i.e., while achieving the first and second objects of the present invention.

What is claimed is:

1. A display panel comprising:

a substrate, a fluorescence layer and an anode electrode, said anode electrode having a lower anode electrode and an upper anode electrode, said lower anode electrode being between said substrate and said fluorescence layer, said lower anode electrode being in contact with said substrate and said fluorescence layer, said fluorescence layer being between said lower anode electrode and said upper anode electrode, said fluorescence layer being in contact with said upper anode electrode, and said lower anode electrode comprises transparent material, said upper anode electrode comprises a non-transparent material.

2. The display panel according to claim 1, wherein:

said non-transparent material comprises aluminum, said transparent material comprises Indium Tin Oxide (ITO), said upper anode electrode thickness is about 0.05 $\mu$m to 0.1 $\mu$m, and said lower anode electrode thickness is about 0.05 $\mu$m to 0.2 $\mu$m.

3. The display panel according to claim 1, wherein a static voltage is applied to said anode electrode.

4. The display panel according to claim 1, wherein a resistance film is in contact with said anode electrode and a power supply line.

5. The display panel according to claim 1, wherein said fluorescence layer comprises a fluorescence material, said fluorescence material being in contact with said lower anode electrode and said upper electrode.

6. A display panel comprising:

a substrate, a fluorescence layer and an anode electrode, said anode electrode having a lower anode electrode and an upper anode electrode, said fluorescence layer being between said substrate and said lower anode electrode, said fluorescence layer being in contact with said substrate and said lower anode electrode, said lower anode electrode being between said fluorescence layer and said upper anode electrode, said lower anode electrode being in contact with said upper anode electrode, and said lower anode electrode comprises transparent material, said upper anode electrode comprises a non-transparent material.

7. The display panel according to claim 6, wherein:

said non-transparent material comprises aluminum, said transparent material comprises Indium Tin Oxide (ITO), said upper anode electrode thickness is about 0.05 $\mu$m to 0.1 $\mu$m, and said lower anode electrode thickness is about 0.05 $\mu$m to 0.2 $\mu$m.

8. The display panel according to claim 6, wherein a static voltage is applied to said anode electrode.

9. The display panel according to claim 6, wherein a resistance film is in contact with said anode electrode and a power supply line.

10. The display panel according to claim 6, wherein said fluorescence layer comprises a fluorescence material, said fluorescence material being in contact with said substrate and said lower anode electrode.

11. A display device comprising:

a display panel and a rear panel, said display panel and said rear panel having a plurality of electron emitting members arranged to be opposed to each other through a vacuum space, said display panel comprising:

a substrate, a fluorescence layer and an anode electrode, said anode electrode having a lower anode electrode and an upper anode electrode, said lower anode electrode being between said substrate and said fluorescence layer, said lower anode electrode being in contact with said substrate and said fluorescence layer, said fluorescence layer being between said lower anode electrode and said upper anode electrode, said fluorescence layer being in contact with said upper anode electrode, and said lower anode electrode comprises transparent material, said upper anode electrode comprises a non-transparent material.

12. The display panel according to claim 11, wherein:

said non-transparent material comprises aluminum, said transparent material comprises Indium Tin Oxide (ITO), said upper anode electrode thickness is about 0.05 $\mu$m to 0.1 $\mu$m, and said lower anode electrode thickness is about 0.05 $\mu$m to 0.2 $\mu$m.

13. The display device according to claim 11, wherein the electron emitting member is a cold cathode field emission device.

14. The display device according to claim 11, wherein a static voltage is applied to said anode electrode.

15. The display device according to claim 11, wherein a resistance film is in contact with said anode electrode and a power supply line.

16. The display device according to claim 11, wherein said fluorescence layer comprises a fluorescence material, said fluorescence material being in contact with said lower anode electrode and said upper electrode.

17. A display device comprising:

a display panel and a rear panel, said display panel and said rear panel having a plurality of electron emitting members arranged to be opposed to each other through a vacuum space, said display panel comprising:

a substrate, a fluorescence layer and an anode electrode, said anode electrode having a lower anode electrode and an upper anode electrode, said fluorescence layer being between said substrate and said lower anode electrode, fluorescence layer being in contact with said substrate and said lower anode electrode, said lower anode electrode being between said fluorescence layer and said upper anode electrode, said lower anode electrode being in contact with said upper anode electrode, and said lower anode electrode comprises transparent material, said upper anode electrode comprises a non-transparent material.

18. The display panel according to claim 17, wherein:

said non-transparent material comprises aluminum, said transparent material comprises Indium Tin Oxide (ITO), said upper anode electrode thickness is about 0.05 $\mu$m to 0.1 $\mu$m, and the lower anode electrode thickness is about 0.05 $\mu$m to 0.2 $\mu$m.

19. The display device according to claim 17, wherein the electron emitting member is a cold cathode field emission device.

20. The display device according to claim 17, wherein a static voltage is applied to said anode electrode.

21. The display device according to claim 17, wherein a resistance film is in contact with said anode electrode and a power supply line.

22. The display device according to claim 17, wherein said fluorescence layer comprises a fluorescence material, said fluorescence material being in contact with said substrate and said lower anode electrode.

* * * * *